US009303339B2

(12) United States Patent
Gupta et al.

(10) Patent No.: US 9,303,339 B2
(45) Date of Patent: Apr. 5, 2016

(54) METHOD AND APPARATUS FOR FORMING A FIBROUS MEDIA

(75) Inventors: Hemant Gupta, Apple Valley, MN (US); Ajay Singh, Apple Valley, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 522 days.

(21) Appl. No.: 13/361,527

(22) Filed: Jan. 30, 2012

(65) Prior Publication Data

US 2012/0193054 A1 Aug. 2, 2012

Related U.S. Application Data

(60) Provisional application No. 61/437,210, filed on Jan. 28, 2011.

(51) Int. Cl.
*D04H 1/70* (2012.01)
*D04H 1/736* (2012.01)
(Continued)

(52) U.S. Cl.
CPC ..... *D04H 1/70* (2013.01); *D04H 1/736* (2013.01); *D04H 18/04* (2013.01); *D21F 11/00* (2013.01)

(58) Field of Classification Search
CPC ..... D04H 1/70
USPC ..... 425/80.1, 81.1, 83.1, 223, 224, 130; 162/129, 130, 131, 141, 149, 188, 216, 162/336, 343, 344, 348, 349, 350, 351, 352, 162/353, 354; 264/212
See application file for complete search history.

(56) References Cited

U.S. PATENT DOCUMENTS 2,036,168 A 3/1936 Engert et al.
3,073,735 A 1/1963 Till et al.
3,119,733 A * 1/1964 Wilson et al. ..... 162/336
(Continued)

FOREIGN PATENT DOCUMENTS

CN 1279241 10/2006
DE 102004046669 3/2006
(Continued)

OTHER PUBLICATIONS

Haider, Peter et al., "Board and Packaging Headbox Technology for the 21st Century", African Pulp and Paper Week: Adding Value in a Global Industry, International Convention Centre, Durban (Oct. 11, 2002), http://tappsa.co.za/archive/APPW2002/Title/Board_and_packaging_headbox-te/board_an . . . (13 pages).
(Continued)

*Primary Examiner* — Timothy Kennedy
(74) *Attorney, Agent, or Firm* — Pauly, DeVries Smith & Deffner LLC

(57) ABSTRACT

Methods and apparatuses for forming a nonwoven web are described herein. The apparatus includes a mixing partition defining one or more openings therein that permit fluid communication between two fluid flow streams, at least one of which includes a fiber. The apparatus also includes an enclosed region surrounding at least a portion of the mixing partition. The enclosed region is adapted to provide an applied pressure to a fluid flow stream to urge the stream through one or more of the openings in the mixing partition. The apparatus also includes a receiving region designed to receive at least a combined flow stream and form a nonwoven web by collecting fiber from the combined flow stream.

49 Claims, 11 Drawing Sheets

(51) Int. Cl.
*D21F 11/00* (2006.01)
*D04H 18/04* (2012.01)

(56) References Cited

U.S. PATENT DOCUMENTS

| | | | | |
|---|---|---|---|---|
| 3,252,854 | A | 5/1966 | Bowen | |
| 3,352,748 | A | 11/1967 | Krofta | |
| 3,514,372 | A | 5/1970 | Boyce | |
| 3,515,635 | A * | 6/1970 | Curtis | 162/339 |
| 3,699,627 | A | 10/1972 | Jouin | |
| 3,720,578 | A | 3/1973 | Heling | |
| RE28,269 | E | 12/1974 | Hill et al. | |
| 4,018,646 | A | 4/1977 | Ruffo et al. | |
| 4,082,476 | A | 4/1978 | Kopelev | |
| 4,321,108 | A | 3/1982 | Goddard et al. | |
| 4,731,135 | A | 3/1988 | Tani et al. | |
| 4,765,915 | A | 8/1988 | Diehl | |
| 4,902,418 | A | 2/1990 | Ziegler | |
| 4,904,385 | A | 2/1990 | Wessling et al. | |
| 5,011,575 | A | 4/1991 | Keller | |
| 5,147,553 | A | 9/1992 | Waite | |
| 5,173,154 | A * | 12/1992 | Heinrich | 162/129 |
| 5,238,474 | A | 8/1993 | Kahlbaugh et al. | |
| 5,336,556 | A | 8/1994 | Yoshida et al. | |
| 5,350,624 | A | 9/1994 | Georger et al. | |
| 5,423,892 | A | 6/1995 | Kahlbaugh et al. | |
| 5,545,475 | A | 8/1996 | Korleski | |
| 5,571,604 | A | 11/1996 | Sprang et al. | |
| 5,622,537 | A | 4/1997 | Kahlbaugh et al. | |
| 5,639,352 | A | 6/1997 | Ruf et al. | |
| 5,645,689 | A | 7/1997 | Ruf et al. | |
| 5,645,690 | A | 7/1997 | Cox, Jr. | |
| 5,669,949 | A | 9/1997 | Dudrey et al. | |
| 5,762,669 | A | 6/1998 | Kahlbaugh et al. | |
| 5,762,670 | A | 6/1998 | Kahlbaugh et al. | |
| 5,792,227 | A | 8/1998 | Kahlbaugh et al. | |
| 5,797,973 | A | 8/1998 | Dudrey et al. | |
| 5,800,587 | A | 9/1998 | Kahlbaugh | |
| 5,972,063 | A | 10/1999 | Dudrey et al. | |
| 5,993,944 | A | 11/1999 | Honna et al. | |
| 6,019,809 | A | 2/2000 | Kahlbaugh et al. | |
| 6,066,235 | A * | 5/2000 | Scheinberg | 162/141 |
| 6,235,377 | B1 | 5/2001 | Dillon et al. | |
| 6,306,539 | B1 | 10/2001 | Zguris | |
| 6,420,626 | B1 | 7/2002 | Erspamer et al. | |
| 6,653,381 | B2 | 11/2003 | Thames et al. | |
| 6,695,148 | B2 | 2/2004 | Homonoff et al. | |
| 6,821,672 | B2 | 11/2004 | Zguris | |
| 6,860,917 | B2 | 3/2005 | Henrichsen et al. | |
| 6,936,554 | B1 | 8/2005 | Singer | |
| 7,115,150 | B2 | 10/2006 | Johnson et al. | |
| 7,309,372 | B2 | 12/2007 | Kahlbaugh et al. | |
| 7,390,760 | B1 | 6/2008 | Chen et al. | |
| 7,510,630 | B2 | 3/2009 | Zilker | |
| 7,520,994 | B2 | 4/2009 | Dong et al. | |
| 7,655,070 | B1 | 2/2010 | Dallas et al. | |
| 7,717,975 | B2 | 5/2010 | Kalayci et al. | |
| 7,910,003 | B2 | 3/2011 | Ferrer et al. | |
| 7,918,913 | B2 | 4/2011 | Kalayci et al. | |
| 8,267,681 | B2 | 9/2012 | Gupta et al. | |
| 8,524,041 | B2 | 9/2013 | Gupta et al. | |
| 9,121,118 | B2 | 9/2015 | Gupta et al. | |
| 2001/0003082 | A1 | 6/2001 | kahlbaugh et al. | |
| 2003/0008214 | A1 | 1/2003 | Zguris | |
| 2003/0082979 | A1 | 5/2003 | Bean et al. | |
| 2004/0116026 | A1 | 6/2004 | Kubose et al. | |
| 2004/0163170 | A1 | 8/2004 | Cooper et al. | |
| 2004/0163781 | A1 | 8/2004 | Hernandez-Munoa et al. | |
| 2005/0026526 | A1 | 2/2005 | Verdegan et al. | |
| 2005/0130031 | A1 | 6/2005 | Zguris | |
| 2006/0094320 | A1 | 5/2006 | Chen et al. | |
| 2006/0096263 | A1 | 5/2006 | Kahlbaugh et al. | |
| 2006/0096932 | A1 | 5/2006 | Dema et al. | |
| 2006/0266701 | A1 | 11/2006 | Dickerson et al. | |
| 2007/0039300 | A1 | 2/2007 | Kahlbaugh et al. | |
| 2007/0190319 | A1 | 8/2007 | Kalayci | |
| 2007/0227359 | A1 | 10/2007 | Choi | |
| 2008/0035103 | A1 | 2/2008 | Barris et al. | |
| 2008/0105629 | A1 | 5/2008 | Yang et al. | |
| 2008/0160856 | A1 | 7/2008 | Chen et al. | |
| 2008/0245037 | A1 | 10/2008 | Rogers et al. | |
| 2009/0221047 | A1 | 9/2009 | Schindler et al. | |
| 2009/0266759 | A1 | 10/2009 | Green et al. | |
| 2010/0031940 | A1 | 2/2010 | Mosset et al. | |
| 2010/0176068 | A1 | 7/2010 | Dallas et al. | |
| 2010/0187171 | A1 | 7/2010 | Gupta | |
| 2010/0187712 | A1 | 7/2010 | Gupta et al. | |
| 2010/0233048 | A1 | 9/2010 | Dallas et al. | |
| 2011/0005394 | A1 | 1/2011 | Joriman et al. | |
| 2011/0017155 | A1 | 1/2011 | Jacob | |
| 2011/0048228 | A1 | 3/2011 | Handley et al. | |
| 2012/0193056 | A1 | 8/2012 | Gupta et al. | |
| 2012/0312488 | A1 | 12/2012 | Gupta et al. | |
| 2013/0340962 | A1 | 12/2013 | Gupta et al. | |

FOREIGN PATENT DOCUMENTS

| | | |
|---|---|---|
| DE | 102006013170 | 9/2007 |
| DE | 2006100013170 | 9/2007 |
| DE | 112010000801 | 9/2012 |
| EP | 109282 | 5/1984 |
| EP | 1746209 | 1/2007 |
| EP | 1905877 | 2/2008 |
| EP | 1905877 | 4/2008 |
| FR | 1405536 | 7/1965 |
| JP | 57178842 | 11/1982 |
| JP | 59228918 | 12/1984 |
| JP | 61275495 | 12/1986 |
| JP | 62033514 | 2/1987 |
| JP | 07299315 | 11/1995 |
| JP | 08-243323 | 9/1996 |
| JP | 09-170199 | 6/1997 |
| JP | 09170199 | 6/1997 |
| JP | 09170200 | 6/1997 |
| JP | 10212683 | 8/1998 |
| JP | 10252000 | 9/1998 |
| JP | 2007090292 | 4/2007 |
| JP | 2012516399 | 7/2012 |
| WO | 9516070 | 6/1995 |
| WO | WO-9516070 | 6/1995 |
| WO | 0075427 | 12/2000 |
| WO | WO-0075427 | 12/2000 |
| WO | WO-03048452 | 6/2003 |
| WO | WO-2006115796 | 2/2006 |
| WO | WO-2006032706 | 3/2006 |
| WO | WO-2006049664 | 5/2006 |
| WO | 2006115796 | 11/2006 |
| WO | WO-2008103736 | 8/2008 |
| WO | WO-2009088647 | 7/2009 |
| WO | WO-2010088403 | 8/2010 |

OTHER PUBLICATIONS

"Non-Final Office Action Received", Non-Final Office Action mailed Dec. 25, 2011 in co-pending U.S. Appl. No. 12/694,935, "Systems and Methods for Meat Processing," (44 Pages).

"Notice of Allowance", mailed May 8, 2012 in co-pending U.S. Appl. No. 12/694,935, titled "Method and Apparatus for Forming a Fibrous Media," (9 pages).

"PCT International Preliminary Examination Report", from International Application No. PCT/US2010/0227427, corresponding to U.S. Appl. No. 12/694,913, mailed Aug. 11, 2011, (12 Pages).

"PCT International Search Report and Written Opinion", from International Application No. PCT/US2012/023147, corresponding to, mailed May 2, 2012, (11 Pages).

"PCT International Search Report and Written Opinion", from International Application No. PCT/US2012/022644, mailed Apr. 10, 2012, (12 Pages).

"Non-Final Office Action", mailed Jul. 23, 2012 in U.S. Appl. No. 12/694,913, "Fibrous Media " (38 pages).

"Non-Final Office Action", for Chinese Patent Application No. 201080005942.9, mailed Nov. 1, 2013 (10 pages).

(56) References Cited

OTHER PUBLICATIONS

"File History for co-owned, co-pending U.S. Appl. No. 12/694,913", As of Feb. 7, 2014, Entitled "Fibrous Media," Filed on Jan. 27, 2010 (400 pages).
File History for co-owned, co-pending U.S. Appl. No. 14/011,337, As of Feb. 7, 2014, Entitled "Method and Apparatus for Forming a Fibrous Media" Filed on Aug. 27, 2013 (230 pages).
"Official Action", for Japanese Patent Application No. 2011-548304, mailed Nov. 25, 2013 (3 pages).
"Communication Pursuant to Rules 161(1) and 162 EPC", from EP Application No. 12702726.6, mailed Sep. 4, 2013, 2 pages.
"Communication Pursuant to Rules 161(1) and 162 EPC", from EP Application No. 12704964.1, mailed Sep. 10, 2013, 2 pages.
"International Preliminary Report on Patentability", from PCT Application No. PCT/2012/022644, mailed Aug. 8, 2013, 7 pages.
"International Preliminary Report on Patentability", from PCT Application No. PCT/2012/023147, mailed Aug. 8, 2013, 7 pages.
"Office Action", from MX Application No. Mx/a/2011/007775, agent letter mailed Jul. 2, 2013, 2 pages.
"Final Rejection", for Japanese Patent Application No. 2011548304, mailed Jul. 31, 2014 (6 pages) with English translation.
"First Office Action", for Application Serial No. 201080005942.9, Mar. 25, 2013 (11 pages).
"Communication pursuant to Article 94(3) EPC", European Examination Report, from the European Patent Office in EP Patent Application No. 10702968.8-1217, corresponding to U.S. Appl. No. 12/694,913, mailed Sep. 25, 2012, (pp. 1-4).
"Final Office Action", mailed Dec. 26, 2012 in co-pending U.S. Appl. No. 12/694,913, "Fibrous Media," (19 pages).
"First Office Action", from EP Application No. 10702968.8, corresponding to U.S. Appl. No. 12/694,913, mailed Sep. 25, 2012, (pp. 1-51).
"Response to Communication pursuant to Article 94 (3) EPC", Response to European Examination Report, dated Sep. 25, 2012, Filed in the European Patent Office on Feb. 5, 2013 for EP Patent Application No. 10702968.8-1217, corresponding to U.S. Appl. No. 12/694,913, (pp. 1-16).
"Response to Final Office Action", mailed Dec. 26, 2012 in co-pending U.S. Appl. No. 12/694,913, filed with the USPTO Feb. 26, 2013 (20 pages).
"Response to Non-Final Office Action", mailed Jul. 23, 2012 in co-pending U.S. Appl. No. 12/694,913, filed with the USPTO Oct. 23, 2012 (17 pages).
"Notice of Allowance" from U.S. Appl. No. 13/589,908, mailed Mar. 21, 2013, 26 pgs.
Communication Pursuant to Article 94(3) EPC, for European Patent Application No. 10702968.8, mailed Mar. 18, 2014 (4 pages).
"Microfiber", http://depts.washington.edu/frcg/MRSA.html, Nov. 2011 (2 pages).
"Non-Final Office Action", for CN Application No. 201080005942.9, mailed Apr. 4, 2014 (5 pages).
"Non-Final Office Action", for U.S. Appl. No. 12/694,913, mailed Apr. 24, 2014 (17 pages).
"JP07299315 English Abstract" Masakatsu Kujira, et al. (1 page).
"JP62033514 English Abstract" Takahashi Wataru, et al. (1 page).
"Communication Pursuant to Article 94(3) EPC", for European Patent Application No. 12702726.6, mailed Jan. 22, 2015 (4 pages).
"Final Office Action," for U.S. Appl. No. 14/011,337, mailed Nov. 19, 2014 (72 pages).
"Final Office Action," for U.S. Appl. No. 12/694,913, mailed Nov. 12, 2014 (30 pages).
"First Office Action," for Chinese Patent Application No. 201280006182.2 mailed Nov. 2, 2014 (20 pages) with English translation.
"Non-Final Office Action," for CN Application No. 201080005942.9, mailed Oct. 20, 2014 (9 pages).
"Non-Final Office Action," for U.S. Appl. No. 13/358,623, mailed on Nov. 24, 2014 (48 pages).
"First Office Action," for Mexico Patent Application No. MX/a/2013/014760, mailed May 13, 2015 (1 page).
"Response to Communication Pursuant to Article 94(3) EPC," for European Patent Application No. 12702726.6, filed May 29, 2015 (43 pages).
"Communication Pursuant to Article 94(3) EPC," for European Patent Application No. 12704964.1, mailed Aug. 19, 2015 (5 pages).
"Communication Under Rule 71(3) EPC," for European Patent Application No. 12702726.6, mailed Sep. 11, 2015 (49 pages).
"Definition of Line," Dictionary.com, accessed Sep. 11, 2015 (10 pages).
"Definition of Linear," Dictionary.com, accessed Sep. 11, 2015 (5 pages).
"Non Final Office Action," for Chinese Patent Application No. 2012800056932, mailed May 21, 2015 (15 pages) with English translation.
"Non-Final Office Action," for U.S. Appl. No. 12/694,913 mailed Sep. 17, 2015 (31 pages).
"Non-Final Office Action," for U.S. Appl. No. 14/011,337 mailed Sep. 3, 2015 (23 pages).
"Second Office Action," for Chinese Patent Application No. 201280006182.2 mailed Jul. 10, 2015 (20 pages) with English translation.
"SPME-Adsorption versus Absorption: Which Fiber is Best for your Application," Supelco, 1999, Sigma-Aldrich Co. (31 pages).
Non Final Office Action, for Japanese Patent Application No. 2014-243159, mailed Oct. 29, 2015 (7 pages) with English translation.
Response to Communication Pursuant to Art 94 (3) EPC, for European Patent Application No. 12704964.1, mailed Aug. 19, 2015 and filed with the EPO Dec. 22, 2015 (15 pages).
Second Office Action, for Mexican Patent Application No. MX/a/2013/014760, mailed May 13, 2015 (3 pages).

* cited by examiner

METHOD AND APPARATUS FOR FORMING A FIBROUS MEDIA

This application claims priority to U.S. Provisional Patent Application No. 61/437,210, filed Jan. 28, 2011, the contents of which are herein incorporated by reference in their entirety.

FIELD OF THE INVENTION

The field of the invention is methods or processes or apparatuses for forming a nonwoven medium comprising controllable characteristics within the medium. The term medium (plural media) refers to a web made of fiber having variable or controlled structure and physical properties.

BACKGROUND

Non-woven fibrous webs or media have been manufactured for many years for many end uses including filtration. Such non-woven materials can be made by a variety of procedures including air laid, spun bonding, melt bonding and papermaking techniques. The manufacture of a broadly applicable collection of media with varied applications, properties or performance levels using these manufacturing techniques have required a broad range of compositions of fiber and other components and often require multiple process steps. In order to obtain an array of media that can serve to satisfy the broad range of uses, a large number of compositions and multi step manufacturing techniques have been utilized. These complexities increase costs and reduce flexibility in product offerings. A substantial need exists to reduce complexity in the need for a variety of media compositions and manufacturing procedures. One goal in this technology is to be able to make a range of media using a single or reduced number of source materials and a single or reduced numbers of process steps.

Media have a variety of applications including liquid and air filtration, as well as dust and mist filtration, among other types of filtration. Such media can also be layered into layered media structures. Layered structures can have a stepwise gradient that results from layer to layer changes. Many attempts at forming true continuous gradients in fibrous media have been directed towards filtration applications. However, the disclosed technology of the prior art of these filter media are often layers of single or multiple component webs with varying properties that are simply laid against one another, or stitched or otherwise bonded together during or after formation. Bonding different layers together during or after layer formation does not provide for a useful continuous gradient of properties or materials. A discrete and detectable interface between layers will exist in the finished product. In some applications, it is highly desirable to avoid the increase in flow resistance that is obtained from such interfaces in the formation of a fibrous medium. For example, in airborne or liquid particulate filtration, the interface(s) between layers of the filter element is where trapped particulate and contaminants often build up. Sufficient particle buildup between layers at the interfaces instead of within the filter media can result in shorter filter life.

Other manufacturing methods such as needling and hydro entangling can improve the mixing of layers, but these methods often result in a filter media that typically contains larger pore sizes which result in low removal efficiencies for particles less than 20 microns (g) in diameter. Also, needled and hydroentangled structures are often relatively thick, heavy basis weight materials which limits the amount of media that can be used in a filter.

Wet laid methods, such as papermaking methods, are used to make nonwoven media having a wide range of pore sizes for high efficiency filtration of small particulates, together with acceptable basis weights; additionally, wet laid methods can employ non-melt processable materials such as glass fibers. Continuous wet laid methods employ dilute aqueous slurries of fiber that are dispensed onto a moving wire mesh or other open or porous support structure, followed by draining or suctioning the liquid from the slurry through the support structure to form a nonwoven medium. Because fiber slurries tend to settle without some level of turbulence, papermaking processes typically employ headboxes, which are designed to deliver a uniform flow of slurry to the support structure. Many headboxes have significant internal structures designed to maintain the fiber dispersion and prevent settling, while avoiding undue turbulence that causes nonuniformity in the slurries as they are dispensed onto the support structure. To that end, headbox internal structures include pluralities of passages, dividers, channels, and the like. These internal structures converge or otherwise end at the point where the slurry exits the headbox, and a uniform slurry is deposited in continuous fashion near the upstream edge of the moving support structure through an opening, called a slice. The slice extends over the cross web direction of the machine and provides a singular, uniform flow across the web. Headboxes are designed to pump large quantities of slurry rapidly onto the support in order to meet industrial requirements of rapid media formation.

SUMMARY

One embodiment of the invention, either alone or in combination with any other embodiments or combination of embodiments listed herein, is an apparatus for making a nonwoven web. The apparatus includes one or more sources configured to dispense a first fluid flow stream comprising a fiber and a second fluid flow stream also comprising a fiber. The apparatus also includes a mixing partition downstream from the one or more sources, where the mixing partition positioned between the first and second flow streams from the one or more sources. The mixing partition defines one or more openings that permit fluid communication between the two flow streams. The apparatus also includes an enclosed region situated downstream from the one or more sources and surrounding at least a portion of the mixing partition, the enclosed region adapted to apply a pressure to the second flow stream to urge the second flow stream through one or more openings in the mixing partition. The apparatus also includes a receiving region situated downstream from the one or more sources and designed to receive at least a combined flow stream and form a nonwoven web by collecting fiber from the combined flow stream.

Another embodiment of the invention, either alone or in combination with any other embodiments or combination of embodiments listed herein, is also an apparatus for making a nonwoven web. The apparatus includes a first source configured to dispense a first fluid flow stream comprising a fiber, a second source configured to dispense a second fluid flow stream also comprising a fiber, and a mixing partition downstream from the first and second sources. The mixing partition is positioned between the first and second flow streams and defines two or more openings in the mixing partition that permit fluid communication and mixing between the first and second flow streams. The apparatus also includes an enclosed region situated downstream from the one or more sources and surrounding at least a portion of the mixing partition, the enclosed region adapted to apply a pressure to the second flow stream to urge the second flow stream through one or more openings in the mixing partition. The apparatus also includes a receiving region situated downstream from the first and second sources and designed to receive at least a combined flow stream and form a nonwoven web by collecting the combined flow stream.

Another embodiment of the invention, either alone or in combination with any other embodiments or combination of embodiments listed herein, is a method of making a nonwoven web. The method includes providing a furnish from a source, the furnish including at least a first fiber, and dispensing the furnish across a mixing partition downstream from the source. The mixing partition defines two or more openings configured to allow passage of at least a portion of the furnish. The mixing partition includes an enclosed region surrounding at least a portion of the mixing partition and adapted to apply a pressure to the furnish. The method further includes applying a pressure within the enclosed region to urge the furnish through one or more of the openings in the mixing partition, collecting fiber from the furnish passing through the two or more openings on a receiving region situated downstream from the source to form a wet layer on the receiving region, and drying the wet layer to form the nonwoven web.

Another embodiment of the invention, either alone or in combination with any other embodiments or combination of embodiments listed herein, is an enclosed mixing partition assembly. The assembly includes a mixing partition and an enclosure surrounding the mixing partition or a section thereof. The mixing partition defines two or more openings. The mixing partition is configured to provide a gradient in a nonwoven web. The assembly further includes at least one inlet for dispensing a fluid therein. The assembly is adapted to provide an applied pressure to the fluid therein.

It will be understood that the various embodiments of the invention, as they are described herein, are intended to be combined with further features, properties, limitations, or embodiments described herein, including combinations thereof, without limitation.

DETAILED DESCRIPTION

Figure 1:
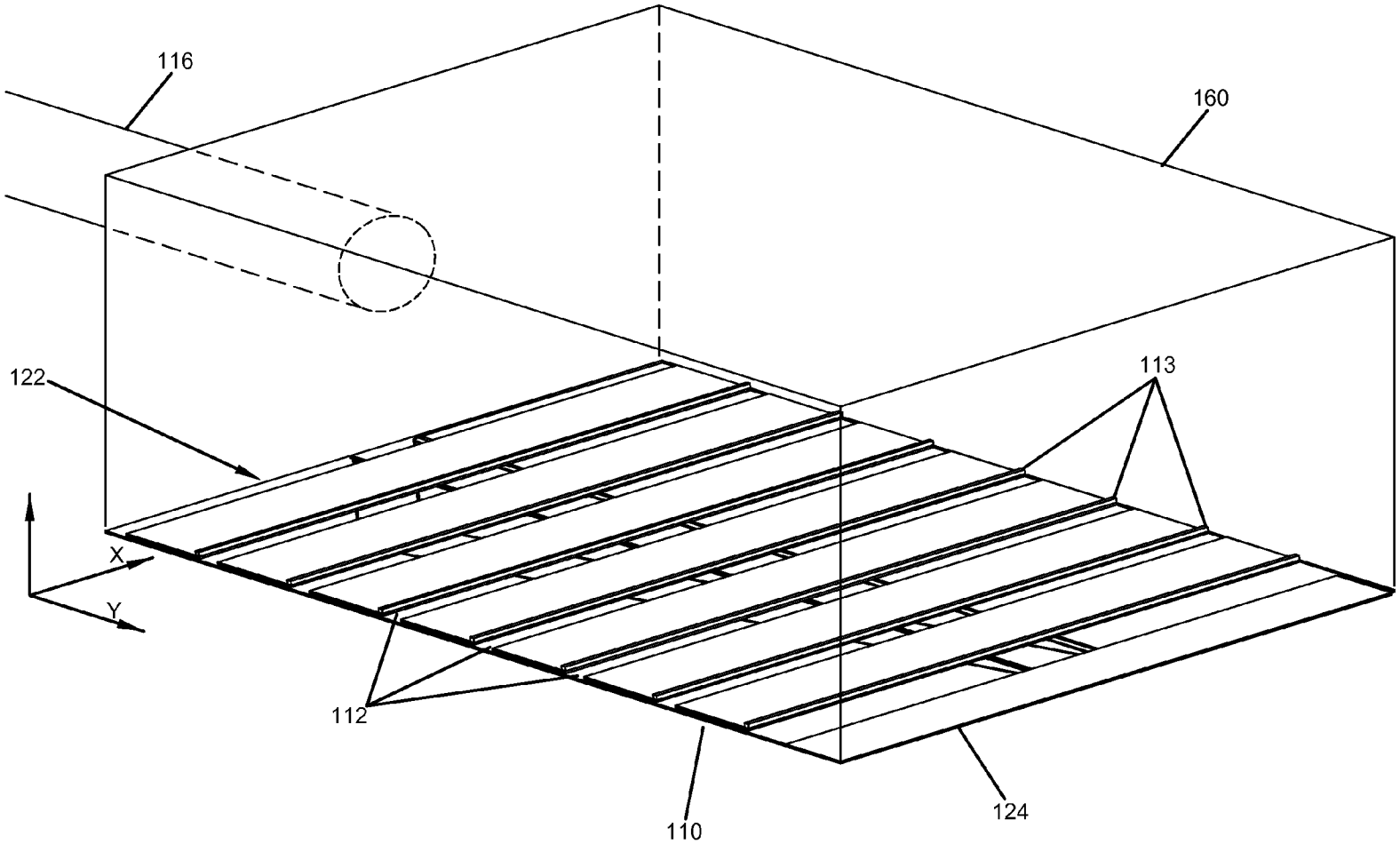
FIG. 1 is a perspective view of one embodiment of an enclosed mixing partition.

Fibrous media having variations or gradients in specific compositions or characteristics are useful in many contexts. One substantial advantage of the technology of this disclosure is the ability to produce a broad range of properties and performance in wet laid media from a single furnish composition or a small set of furnishes. A second advantage is the ability to produce this broad spectrum of products using a single wet laid media forming process. A third advantage is the ability to form the gradient media at line speeds of about 4 meter/min or more, for example 10 meter/min, or up to about 2000 meter/min or even faster.

Once formed, the media has excellent performance characteristics, even without further processing or added layers. A single furnish can be used to produce a gradient media with varying properties across one or more directions of the media. Fibrous media having controllable and predictable gradient characteristics such as fiber chemistry, fiber diameter, crosslinking or fusing or bonding functionality, presence of binder or sizing, presence of particulates, and the like are advantageous in many diverse applications. Applications include various gaseous and fluid filtration applications. The gradient media provided by the apparatuses and methods of the invention have enhanced performance in filtration applications over single layer or multilayer filters commonly employed in the industry. Gradients of materials and their associated attributes are advantageous when provided through either the thickness of a fibrous media, or over another dimension such as cross-web (width) or machine-direction (length) of a fibrous media sheet.

These gradient media, including various characteristics and physical properties incorporated therein, are described in International Patent Application No. WO 2010/088403 and U.S. Patent Application Nos. US 2010/0187171 and US 2010/0187712, the contents of which are incorporated herein in their entirety. Described herein are apparatuses and methods usefully employed in forming the gradient media described in the foregoing cited patent documents. The apparatuses and methods of the invention are usefully employed to form any of the gradient media described in International Patent Application No. WO 2010/088403 and U.S. Patent Application Nos. US 2010/0187171 and US 2010/0187712, without limitation.

Using the apparatuses described herein, controlled gradient web structures in a nonwoven are made using wet laid processes. The apparatuses of the invention, and the processes enabled by the apparatuses, result in the rapid formation of the gradient web structures.

1. DEFINITIONS

As used herein, the term "web" relates to a sheet-like or planar structure having a thickness of about 0.05 mm to an indeterminate or arbitrarily greater thickness. This thickness dimension can be 0.5 mm to 2 cm, 0.8 mm to 1 cm or 1 mm to 5 mm. A web has a width that can range from about 2.00 cm to an indeterminate or arbitrary width. A web has an indeterminate or arbitrary length. A web is flexible, machinable, pleatable and otherwise capable of forming into a filter element or filter structure.

As used herein, the term "filter medium" (or media) means a nonwoven layer having at least minimal permeability and porosity such that it is useful as a filter structure and is not a substantially impermeable layer such as conventional paper, coated stock or newsprint.

As used herein, the term "gradient" means a continuous variation within at least a region of a web. A gradient can be a physical property gradient or a chemical property gradient. A gradient can be a gradient of permeability, pore size, fiber diameter, fiber length, efficiency, solidity, wettability, chemical resistance, mechanical strength, or temperature resistance, or a combination of one or more thereof. A gradient can be a gradient of fiber size, fiber composition, fiber concentration, or any other compositional aspect or combination of aspects. A gradient can be present across any direction of a web. A web can have more than one gradient. A web can have gradients through more than one direction of the web. A gradient can be a linear or non-linear gradient.

As used herein, the term "fiber" refers to a source of fiber. Sources of a fiber are typically fiber products, wherein large numbers of the fibers have similar composition diameter and length or aspect ratio. For example, bicomponent fiber, glass fiber, polyester and other fiber types are provided in large quantity having large numbers of substantially similar fibers. Such fibers are typically employed, for the purposes of the present invention, in a furnish.

As used herein, the term "mixing partition" means a mechanical barrier between a flow stream and at least a receiving area that defines at least two open areas that impart a controlled degree of dispensing of a fluid flow stream to the receiving area.

In the mixing partition, the term "slot" refers to an opening that has a first dimension that is significantly larger than a second dimension, such as a length that is significantly larger than a width.

As used herein, the term "source" means a point of origin, such as a point of origin of a fluid flow stream including a fiber. One example of a source is a nozzle. Another example is a headbox.

As used herein, the term "headbox" means a device configured to deliver a substantially uniform flow of furnish across a width. In some cases, pressure within a headbox is maintained by pumps and controls. For example, in some embodiments an air-padded headbox employs a mechanism such as a piston in conjunction with an air-space above the furnish as a means of pressurizing the headbox contents and driving the flow out of the headbox slice. In other embodiments, an air-padded headbox is open to the atmosphere, and the force of gravity on the furnish inside the headbox drives the flow. In such embodiments, the level of furnish inside the headbox is varied in order to affect the flow rate out of the slice. In some embodiments, the headbox is an hydraulic headbox. In some embodiments, a headbox also includes rectifier rolls, which are cylinders with large holes in them, slowly rotating within an air-padded headbox to help distribute the furnish. In hydraulic headboxes, redistribution of furnish and break-up of flocculants is achieved with banks of tubes, expansion areas, and changes of flow direction.

As used herein, the term "furnish" means a blend of fibers and liquid. In some embodiments, the liquid includes water. In some embodiments, the liquid is water and the furnish is an aqueous furnish. In some embodiments the furnish includes a blend of two or more fibers, two or more liquids, or both. In some embodiments the furnish includes one or more additional materials.

As used herein, the term "machine direction" is the direction that a web travels through an apparatus, such as an apparatus that is producing the web. Also, the machine direction is the direction of the longest dimension of a web of material.

As used herein, the term "cross web direction" means the direction perpendicular to the machine direction.

As used herein, the terms "x-direction" and "y-direction" mean the width and length of a fibrous media web, respectively, and the "z-direction" means the thickness or depth of the fibrous media. As used herein, the x-direction is identical to the cross web direction and the y-direction is identical to the machine direction.

As used herein, the term "downstream" means the direction of flow of at least one flow stream in the apparatus forming the web. When a first component is described as being downstream of a second component herein, it means that at least a portion of the first component is downstream of the entirety of the second component. Portions of the first and second component may overlap even though the first component is downstream of the second component.

As used herein, the term "single pass" means deposition of furnish or furnishes occurs only once during a production run to produce a gradient media. No further processing is done to enhance the gradient.

As used herein, the term "applied pressure" means any pressure in excess of the inherent gravitational force on the furnish that exists at the point where a furnish traverses the mixing partition.

As used herein, the term "line speed" means the speed of media formation on a wire forming apparatus. Typically, though not always, line speed is expressed in units of meters per minute (meter/min or M/min).

As used herein, the term "enclosure" means a three dimensional chamber surrounding a mixing partition or a section thereof, such that an "enclosed mixing partition" includes the enclosure and the mixing partition or section thereof. The enclosed mixing partition has at least one inlet for dispensing a liquid into the chamber, and optionally has other openings that can be closed or open selectively. The enclosed mixing partition is adapted to provide an applied pressure to a fluid within the enclosed mixing partition.

2. DESCRIPTION OF METHODS & APPARATUSES

A substantial advantage of the technology of the invention is to obtain an array of media with a range of useful properties using one, or a limited set of furnishes and a single step wet-laid process wherein line speeds of 4 meter/min to 2000 meter/min or more are achieved.

a. Enclosed Mixing Partition and Media Forming Apparatus

In an embodiment, a single pass wet-laid process is used to generate a gradient media at line speeds of 4 meter/min to 2000 meter/min or higher. The apparatus employed to generate the gradient media at such line speeds includes an enclosed mixing partition that is adapted to apply a pressure across the mixing partition in order to increase the flow rate of a furnish across the mixing partition.

Figure 2:
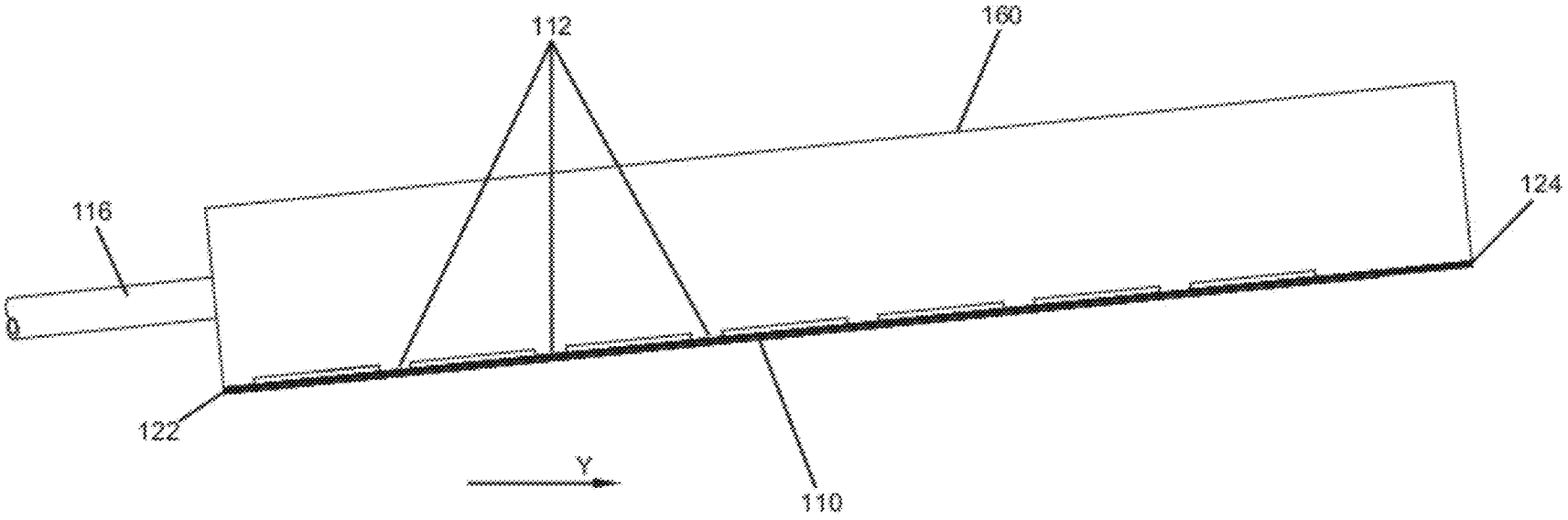
FIG. 2 is a side view of the enclosed mixing partition of FIG. 1.

One embodiment of an enclosed mixing partition is shown in FIGS. 1 and 2. FIG. 1 shows a perspective view of an enclosed mixing partition and FIG. 2 shows a side view of the same enclosed mixing partition. In this embodiment, mixing partition 110 is surrounded by enclosure 160. Feed tube 116 provides a fluid flow stream to the mixing partition 110 via an inlet near proximal end 122, and the fluid flows in the Y-direction toward distal end 124 and through openings 112. In some embodiments such as those represented by FIG. 1, the fluid flow stream is supplied to feed tube 116 from a feedbox or other source where a pump or another apparatus supplies a pressurized flow. In embodiments the flow of fluid into the enclosure is faster than the rate at which ambient gravitational pressure causes the fluid to pass through openings 112. In such embodiments an effective pressure forms within enclosure 160, causing the fluid to pass through the openings 112 faster than the rate at which the fluid would flow in the absence of the enclosure 160. In such embodiments, the applied pressure is any amount of pressure impinging on a fluid within enclosed mixing partition 110, 160 that is in excess of the inherent gravitational force on the fluid that exists at the point where the fluid traverses openings 112. It will be appreciated that in such embodiments, the applied pressure is dependent on the rate of fluid flowing through feed tube 116 relative to the rate of dispensing the fluid through openings 112. Optional weirs 113 may be situated on the upstream edge of openings 112. The rate of dispensing is in turn dependent at least upon the size and number of openings 112 in mixing partition 110. In some embodiments, enclosed mixing partition 110, 160 is substantially filled with fluid and no appreciable airspace is present during dispensing of fluid through openings 112. In other embodiments, the enclosed mixing partition 110, 160 is partially filled with fluid during dispensing and an airspace is present. In embodiments, the fluid entering the enclosed mixing partition 110, 160 is a furnish.

The enclosure 160 of FIG. 1 is a cuboid shape and thus includes an end wall at its distal end 124. When a flow stream is present in the enclosure 160, the end wall stops the horizontal momentum of the flow stream, and therefore the end wall assists with maintaining an even pressure across the openings 112 within enclosure 160. In some embodiments, the end wall at distal end 124 is movable across the plane defined by the mixing partition 110. In such embodiments, the effective volume of the enclosed mixing partition 160, 110, the effective area of mixing partition 110, and in some embodiments the effective number of openings 112 is adjustable. In some such embodiments, the wall at distal end 124 is slidably movable within enclosure 160 and across mixing partition 110. In other embodiments, a series of set end wall positions are provided such that one of these positions is selected by the user. In some embodiments, the movable wall is removable altogether from the enclosure; in such embodiments, the removable wall allows for maintenance, cleaning, or reconfiguration of the mixing partition or the enclosure. Further, in such embodiments, the removable wall can be removed during media formation; in other words, the user can select whether or not to employ an open mixing partition or an enclosed mixing partition.

In the embodiment illustrated by FIG. 2, the enclosure 160 of FIG. 1 is shown on an incline relative to the horizontal plane, wherein the horizontal plane is illustrated by the arrow indicating the Y direction. It will be appreciated that the enclosure 160, mixing partition 110, or both are employed, in some embodiments, in an inclined disposition as shown in FIG. 2. In other embodiments, no incline is employed. In still other embodiments, a greater incline than that represented in FIG. 2 is employed.

Figure 3:
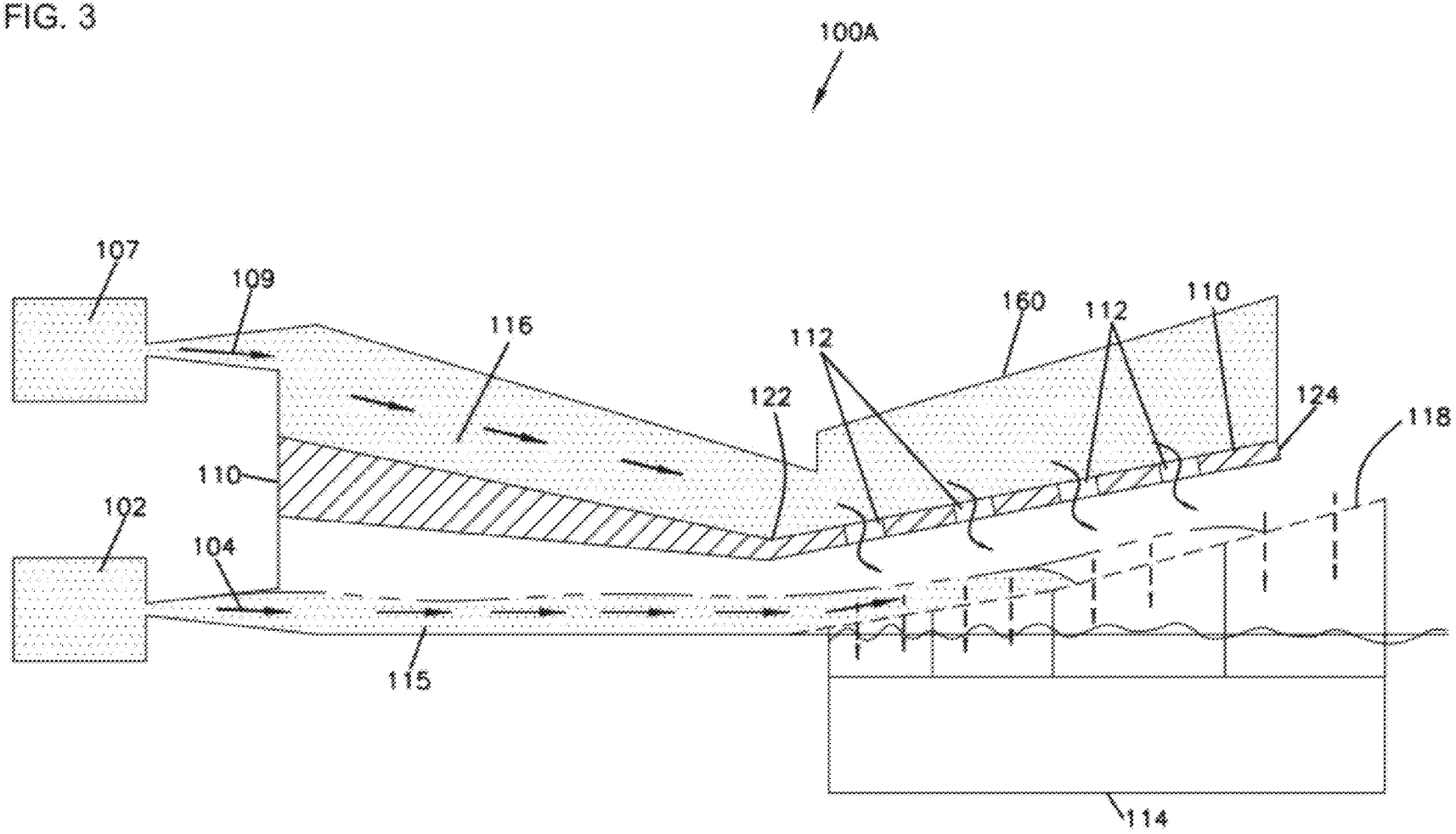
FIG. 3 is a schematic cross-sectional view of one embodiment of an apparatus for forming a nonwoven web.

An enclosed mixing partition such as the one shown in FIGS. 1 and 2 is shown as part of an inclined wire forming apparatus in FIG. 3. FIG. 3 shows a schematic cross-sectional view of a modified inclined papermaking apparatus 100A with two sources 102, 107 and a mixing partition 110. Source 102 supplies fluid flow stream 104. Source 107 is configured as a headbox or another apparatus that supplies a pressurized fluid flow stream 109. At least one of the fluid flow streams 104, 109 is a furnish. Feed tube 115 carries fluid flow stream 104 away from the source 102. Feed tube 116 carries pressurized fluid flow stream 109 away from source 107. The mixing partition 110 is present at the distal end of feed tube 116. Mixing partition 110 defines openings 112 and is surrounded by enclosure 160. The mixing partition has a proximal end 122 closest to the sources and a distal end 124 distant from the sources. At a distal end of the lower feed tube 115, fluid flow stream 104 is conveyed on a wire guide 118 that is taken up on rollers (not shown) that are known in the art. On the wire guide, fluid flow stream 104 moves into the area above the receiving region 114.

In a related embodiment (not shown), mixing partition openings 112 are present over the entirety of mixing partition 110 starting from source 107.

Pressurized fluid flow stream 109 enters enclosure 160. Portions of the pressurized fluid flow stream 109 descend through openings 112, as urged by pressure applied to or built up within enclosure 160 by pressurized source 107 and further as permitted by the dimensions of the openings 112, onto the wire guide 118 directly above the receiving region 114. As a result, the pressurized fluid flow stream 109 mixes with flow stream 104 in the area above the receiving region 114. In embodiments, pressurized fluid flow stream 109 flows through openings 112 faster than the same fluid flow stream would flow through the same openings in the absence of enclosure 160. The faster rate of flow in turn enables fluid flow stream 104 and wire guide 118 to proceed at higher rates, corresponding to a higher line speed, while achieving the same extent of mixing of the two fluid flow streams as can be achieved using the slower speeds necessitated by using apparatus 100A in the absence of enclosure 160. Thus, the line speed of apparatus 100A in forming the gradient media of the invention is increased as enabled by the pressurized flow stream 109 in conjunction with enclosure 160. In some embodiments, source 102 is also a pressurized source.

In embodiments, certain features of the apparatus of FIG. 3 are similar to a paper-making type apparatus. Paper-making machines in the prior art are known to have partition structures that are solid and permit minimal mixing of two fluid flow streams. The enclosed mixing partition structure of the invention is adapted with apertures of various geometries that cooperate with the at least two fluid flow streams to obtain a desired level and location of mixing of the fluid flow streams. In one embodiment, the enclosed mixing partition is used in the context of a modified paper machine such as an inclined papermaking machine or other machines that will be further discussed herein. The enclosed mixing partition can be positioned on a horizontal plane, or on a downward or upward incline. Furnishes leaving the sources on the machine proceed to a formation zone or receiving region. The fluid flow streams are at least initially separated by the enclosed mixing partition. The enclosed mixing partition of the invention has slots or openings in its surface to permit rapid but controlled mixing of the fluid flow streams.

In some embodiments, sources 102, 107 and feed tubes 115, 116 shown in FIG. 3 are a supplied as part of a hydroformer machine, such as a DELTAFORMER™ machine (available from Glens Falls Interweb, Inc. of South Glens Falls, N.Y.), which is a machine designed to form very dilute fiber slurries into fibrous media. The hydroformer is adapted to include the enclosed mixing partition of the invention, such that source 107 and feed tube 116 is directed into the enclosed mixing partition 160 instead of being directly dispensed onto wire 118.

Referring again to FIG. 3, it will be understood that in most embodiments of the apparatus of the invention, pressure will be built up inside the enclosure 160 once all openings 112 are covered by fluid flow stream 109. Thus, in such embodiments, the rate at which source 107 causes fluid flow stream 109 to flow into the enclosed mixing partition 110, 160 must initially be greater than the rate at which gravity causes fluid flow stream 109 to pass through mixing partition openings 112 in order to cover all the openings 112 and begin building pressure inside the enclosed mixing partition 100, 160. In some embodiments, fluid flow stream 109 substantially fills the entire enclosed mixing partition 110, 160. Absent an external source of pressure applied independently to enclosed mixing partition 110, 160, the pressure applied to the fluid flow stream 109 is supplied solely by the accrual of fluid flow stream 109 inside the enclosed mixing partition 110, 160. In such embodiments, if not for enclosure 160, flow stream 109 would spill over distal end of the mixing partition 110, or over the sides thereof. Absent enclosure 160, the rate of media formation—that is, line speed—is limited by the rate of dispensing fluid flow stream 109 across mixing partition openings 112 as aided solely by gravity. The line speed in the apparatus including the enclosed mixing partition 110, 160 must be balanced with the rate at which fluid flow stream 109 traverses openings 112 in order to obtain a desired level and location of mixing with fluid flow stream 104; other than this, the line speed is not particularly limited.

In any of the embodiments described herein where an enclosed mixing partition is employed, a fluid may have a pressure applied thereto as it traverses the mixing partition and is dispensed onto the wire mesh conveyor. Applying pressure to a fluid as it traverses the mixing partition increases the rate of flow of the fluid through the openings of the mixing partition and onto the wire mesh conveyor. In some embodiments, applying pressure to the fluid as it traverses the mixing partition results in faster media forming rates of the gradient media of the invention in conjunction with the apparatuses and processes of the invention. In some embodiments, sources of applied pressure other than a pressurized flow of fluid are employed; such embodiments are described in more detail below.

In embodiments, relative to the speed of media formation where no enclosed mixing partition is used, gradient media formation speeds of 1.5 to 10 times higher, 2 to 100 times higher, or even as much as 10 to 1000 times higher can be achieved when pressure is applied to the furnish as it traverses the mixing partition, as facilitated by the enclosed mixing partition. In embodiments, the rate of flow of a volume of fluid, for example a furnish, that can pass through the mixing partition openings of the enclosed mixing partition is about 1.5 to 1000 times faster than when the same fluid flows through the mixing partition via gravitational force alone, or 10 to 500 times faster, or about 1.5 to 100 times faster. Line speeds of about 4-10 meter/min, or about 10-100 meter/min, or about 100-500 meter/min, or about 500-1000 meter/min, or even as high as about 1000-2000 meter/min, or in some embodiments higher than 2000 meter/min, are achieved by employing an enclosed mixing partition to form gradient media instead of a mixing partition without an enclosure. One of skill will appreciate that the limitations on the rate of flow of a volume of fluid through the openings of the mixing partition in an enclosed mixing partition is limited only with respect to rate of fluid flow into the enclosed mixing partition, the force exerted by the source of fluid or an external source of pressure, the overall volume of the enclosed mixing partition, the size and number of the openings provided by the mixing partition, and the rheological characteristics of the fluid flowing through the openings in the mixing partition.

In various embodiments, the mixing partition has one opening, two openings or more openings for dispensing fluids, such as furnishes, onto a wire. The shapes and orientations of the openings of the mixing partition allow a specific and controlled gradient structure to be achieved in the web while also enabling rapid rates of web formation. In some embodiments, the openings are a series of cross web slots, where the slots extend across the entirety of the cross web direction of the mixing partition and define openings ranging from about 0.05 cm to 25 cm, or about 0.1 cm to 10 cm, or about 0.25 cm to 8 cm in the down web direction; and further define solid rectangular sections or slats between the openings ranging from about 2 cm to 100 cm between slots, or about 5 cm to 75 cm, or about 7 cm to 50 cm. Such configurations of the mixing partition result, in various embodiments, in excellent control of thickness gradients through the fibrous media formed using the enclosed mixing partition, and excellent uniformity in the cross web direction. More details of mixing partition design are described below.

The enclosure surrounding the mixing partition has a variable shape that is optimized and fitted for particular media forming apparatuses and/or pressure control. The enclosed mixing partition 110, 160 of FIGS. 1-3 is a generally cuboid shape, that is, a three-dimensional shape constructed from three pairs of rectangular sides, and wherein mixing partition 110 forms one of the six sides. However, in various embodiments other shapes are employed. Suitable shapes of enclosed mixing partitions include cubic, cuboid, wedge-shaped, square pyramidal, and frusto-quadrilateral (apex-truncated square pyramidal). In general, any three-dimensional shape that accommodates the input of furnish, applied pressure thereto, and a suitably fitted mixing partition is included in the enclosed mixing partition designs of the invention.

The gradient media formed using the enclosed mixing partition apparatus of the invention is the result of rapid but controlled mixing of fluid flow streams, wherein at least one fluid is a furnish. Where two fluid flow streams are furnishes, at least one fiber gradient is formed in some embodiments. Depending on the design of the mixing partition, in some embodiments more than one fiber gradient is formed, for example, gradients through both the thickness and the cross web direction of the web. When more than two furnishes are employed using the apparatus and methods of the invention, then three or more fiber gradients can be formed. Further, one or more than one mixing partition may be employed. Where two or more mixing partitions are employed, at least a portion of one thereof is an enclosed mixing partition. Further, in some embodiments where a single mixing partition is employed, only a portion thereof is enclosed and adapted to provide an applied pressure to a fluid within the enclosed mixing partition. Various embodiments including multiple sources of fluids, for example multiple headboxes supplying multiple furnishes of varying composition, are employed in embodiments where more than one mixing partition or mixing partition section are employed, such that the mixing partitions or mixing partition sections are situated in series in the downstream (machine) direction. In such embodiments, one or more of the mixing partitions or mixing partition sections are enclosed mixing partitions or mixing partition sections. In some embodiments, more than one mixing partition is employed wherein two or more mixing partitions are stacked one on top of the other. In still other embodiments, two or more mixing partitions or mixing partition sections are situated side-by-side, that is, in the cross web direction.

Thus, one of skill will appreciate that a virtually unlimited selection of fluids that are furnishes or that supply some other component (such as particles, crosslinkers, binders, and the like) or mixture of two or more components are employed to form any number of gradient compositions in the media of the invention. A variety of gradient types (cross web, thickness, or both) are just as easily formed by using more than one mixing partition or mixing partition section designs; and varying levels of material addition are easily achieved by employing variably pressurized flows of materials across the one or more mixing partitions or mixing partition sections. Thus, in one such embodiment, an open (non-enclosed) mixing partition having a first furnish supplied with a first headbox is situated in series with an enclosed mixing partition having a second furnish supplied with a second headbox, and this is further situated in series with an enclosed mixing partition having a third furnish supplied with a third headbox and further adapted to have hydraulic pressure supplied thereto. Many such variable arrangements are envisioned within the scope of the invention, and many variations on type of gradient and extent of mixing are possible in conjunction with an apparatus, such as a papermaking apparatus.

It will be appreciated that an additional level of controlled mixing is achieved by employing either partially enclosed mixing partitions or multiple mixing partitions wherein one or more thereof is an enclosed mixing partition adapted to apply a pressure. It will be appreciated that mixing may be varied cross web during medium formation by selecting a pattern of openings in the mixing partition that vary cross web. It will be appreciated that the machine and mixing partition of the invention offer this variability and control with ease and efficiency. It will be appreciated that gradient media will be formed in one pass or application over the mixing partition. It will be appreciated that gradient materials, e.g. fibrous media having no discernible discrete interfaces, but having controllable chemical or physical properties that vary in one or more directions through the web, may be formed using the apparatuses and methods of the invention. It will be appreciated that the concentration or ratio of, for example, variable fiber sizes, provides an increasing or decreasing density of pores throughout a specific gradient media. The fibrous media so formed may be advantageously employed in a wide variety of applications.

b. Mixing Partition Design and Features

The dimensions and positions of the mixing partition openings will have a large effect on the timing and level of mixing of the fluid flow streams. In one embodiment, such as the apparatus shown in FIG. 3, a first portion of the fluid flow stream 109 will pass through a first opening 112, and a second portion of the fluid flow stream 109 will pass through a second opening 112, and a third portion of the fluid flow stream 109 will pass through a third opening 112, and so on.

There are many different options for the design of the mixing partition. For example, larger or more frequent openings at the end of the mixing partition proximal to the fluid inlet will result in more mixing when the furnishes retain the most liquid. Larger or more frequent openings at the end of the mixing partition distal to the fluid inlet will result in mixing after more liquid has been removed. Depending on the materials present in the furnish(es) and the desired gradient properties, more mixing at earlier stages of the medium forming process or more mixing later in the medium forming process may provide advantages in the final construction of the gradient media.

The mixing partition and its openings can have any geometrical shape. One example is a slotted mixing partition. In one embodiment, the mixing partition defines rectangular openings which are slots in the cross-web or cross-flow direction. These rectangular slots can extend across the entire cross web width in one embodiment. In another embodiment, the mixing partition defines slots in the downstream or machine direction. The apertures or slots can be of variable width. For example, the slots may increase in width in the down web direction or the slots may increase in width in the cross web direction. The slots can be spaced variably in the down web direction. In other embodiments, the slots proceed in the cross web direction from one side of the web to the other. In other embodiments, the slots proceed over only part the web from one side to the other. In other embodiments, the slots proceed in the down web direction, from the proximal end of the mixing partition to the distal end. For example, the slots can be parallel to the path of flow taken by the furnishes as they leave the sources. Combinations of slot designs or arrangements may be used in the mixing partition.

In other embodiments, the mixing partition defines open areas that are not slots, e.g. the open areas that do not progress in the cross web direction from one side to the other. In such embodiments, the open areas in the mixing partition are discrete holes or perforations. In other embodiments, the openings are large round holes in the mixing partition several inches in diameter. In embodiments, the holes are circular, oval, rectilinear, triangular, or of some other shape. In one particular embodiment, the openings are a plurality of discrete circular openings. In some embodiments, the openings are regularly spaced over the mixing partition. In other embodiments, the openings are spaced irregularly or randomly over the mixing partition.

A purpose of incorporating open areas in the mixing partition is, for example, to supply fibers from one furnish reservoir and mix with fibers from a second furnish reservoir in controlled proportions. The mixing proportions of the furnishes is controlled by varying the magnitude and location of open areas along the length of the mixing partition. For example, larger open areas provide more mixing of the furnishes and vice versa. The position of these open areas along the length of the mixing partition determines depth of mixing of the furnish streams during formation of the gradient fibrous mat.

There are many possible modifications of the mixing partition relative to the distribution, shape, and sizes of open areas. Some of these modifications are, for example, 1) rectangular slots with progressively increasing/decreasing areas, 2) rectangular slots with constant areas, 3) varying number of slots with varying shapes and positions, 4) porous mixing partition with slots confined to initial section of the mixing partition base only, 5) porous mixing partition with slots confined to final section mixing partition base only, 6) porous mixing partition with slots confined to middle section only, or 7) any other combination of slots or open areas. The mixing partition can be of variable length.

Two particular mixing partition variables are the magnitude of the open area within the mixing partition and the location of the open area. These variables control the deposition of the mixed furnish producing the fibrous mat. The amount of mixing is controlled by the open areas in the mixing partition relative to the dimensions of the mixing partition. The region where mixing of the different furnish compositions occurs is determined by the position of the opening(s) or slot(s) in the mixing partition apparatus. The size of the opening determines the amount of mixing of fibers within a receiving region. The location of the opening, i.e. towards the distal or proximal end of the mixing partition, determines the depth of mixing of the furnishes in the region within the fibrous mat of the gradient media. The pattern of slots or openings may be formed in a single piece of material, such as metal or plastic, of the base of the mixing partition. Alternatively, the pattern of slots or openings may be formed by many pieces of material of different geometric shapes. These pieces may be fabricated from metal or plastic to form the base of the mixing partition. In general, the amount of open area within the mixing partition apparatus is directly proportional to the amount of mixing between fibers supplied by the furnish reservoirs.

In another embodiment, the mixing partition comprises one or more openings defined by one or more openings extending in a down web direction of the mixing partition. The one or more openings can extend from a first down web edge of a mixing partition piece to an up-web edge of a mixing partition apparatus. This positioning of openings slots between material pieces may proceed down web for several iterations depending on the required final chemical and physical parameters of the gradient media being produced. Thus, the one or more openings may comprise a plurality of openings comprising different widths, different lengths, different orientations, different spacing, or a combination thereof. In one particular embodiment, the mixing partition defines at least a first opening having first dimensions and at least a second opening having second, different dimensions.

In one embodiment, the mixing partition comprises one or more openings extending in a cross web direction of the mixing partition. The pieces of the mixing partition extend to each side of apparatus. The one or more openings extend from a first cross web edge of a mixing partition piece to a second cross web edge of a mixing partition. This positioning of openings between pieces of the mixing partition pieces may proceed cross web for several iterations depending on the required final chemical and physical parameters of the gradient media being produced. Thus, the one or more openings may comprise a plurality of openings comprising different widths, different lengths, different orientations, different spacing, or a combination thereof.

In one embodiment, the mixing partition comprises one or more openings defined by one or more holes or perforations extending in a down web direction of the mixing partition. The holes or perforations may be microscopic to macroscopic in size. The one or more holes or perforations extend from a first down web edge of the mixing partition to a second down web edge of mixing partition. This positioning and frequency of holes or perforations may proceed down web for several iterations depending on the final chemical and physical parameters of the gradient media being produced. Thus, the one or more holes or perforations comprise a plurality of holes or perforations comprising different sizes, different locations, different frequencies, different spacing, or a combination thereof.

The mixing partition comprises one or more openings defined by one or more holes or perforations extending in a cross web direction of the mixing partition. This positioning and frequency of holes or perforations may proceed cross web for several iterations depending on the final chemical and physical parameters of the gradient media being produced. Thus, the one or more holes or perforations comprise a plurality of holes or perforations comprising different sizes, different locations, different frequencies, different spacing, or a combination thereof.

The downstream, or machine direction, dimension of the mixing partition or the enclosed mixing partition is not particularly limited, and generally proceeds downstream from a first selected point where fluid is desirably applied by an enclosed mixing partition to the wire guide to accomplish mixing, to a second selected point downstream which is typically before the end of the draining or suction portion of the machine. In one embodiment, a dimension of the mixing partition in the machine direction is at least about 29.972 cm. (11.8 inches) and at most about 149.86 cm. (59 inches), while in another embodiment it is at least about 70.104 cm. (27.6 inches) and at most about 119.38 cm. (47 inches). Where more than one mixing partition is employed on a single machine, the mixing partitions have the same or different downstream dimensions.

In one embodiment, the one or more openings of a mixing partition occupy at least 1% and at most 80% of the total area of the mixing partition, or at least 3% and at most 50% of the total area of the mixing partition, or at least 5% and at most 30% of the total area of the mixing partition.

In one embodiment of the mixing partition that accomplishes an x-gradient (cross web gradient) in the media, the mixing partition has a central axis in the machine direction dividing the mixing partition into two halves, and one half is not identical to the other half. In some embodiments, one half has no openings and the other half defines the opening or openings. In another mixing partition that accomplishes an x-gradient the mixing partition has a first outer edge and a second outer edge, where the first and second outer edges are parallel to the machine direction, and the mixing partition defines a first opening that varies in machine-direction-width so that the machine-direction-width closest to the first outer edge is smaller than the machine-direction width closest to the second outer edge. In another example of an embodiment that accomplishes an x-gradient, the mixing partition has a first edge portion without openings and a second edge portion without openings. The first and second edge portions each extend from a downstream cross-web edge to an upstream cross-web edge. The mixing partition further comprises a central portion between the first and second edge portions and one or more openings are defined in the central portion.

Figure 4:
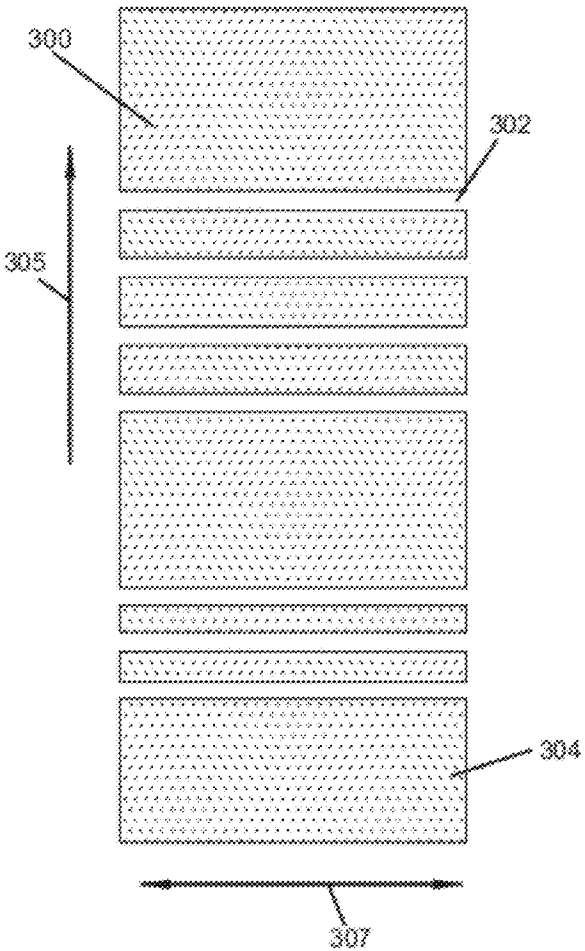

Various configurations of the openings of the mixing partition are shown in FIGS. 4 to 9, which are top views of mixing partitions. Each mixing partition of FIGS. 4 to 9 has a different configuration of openings. Each mixing partition has side edges, a first end edge and a second end edge. The side edges of the mixing partitions are attachable to the left and right side walls of the machine (not shown). In FIGS. 4 to 9, the arrow 305 indicates the downweb, or machine, direction while arrow 307 indicates the cross-web direction. FIG. 4 shows mixing partition 300 having seven cross web slot-shaped openings 302 of substantially equal rectangular areas, spaced apart in the cross web direction. Three slots 302 are evenly spaced from each other, and in a different portion of the mixing partition, four slots 302 are evenly spaced from each other. The mixing partition 300 includes an offset portion 304 adjacent to the first edge, where no openings are present.

Figure 6:
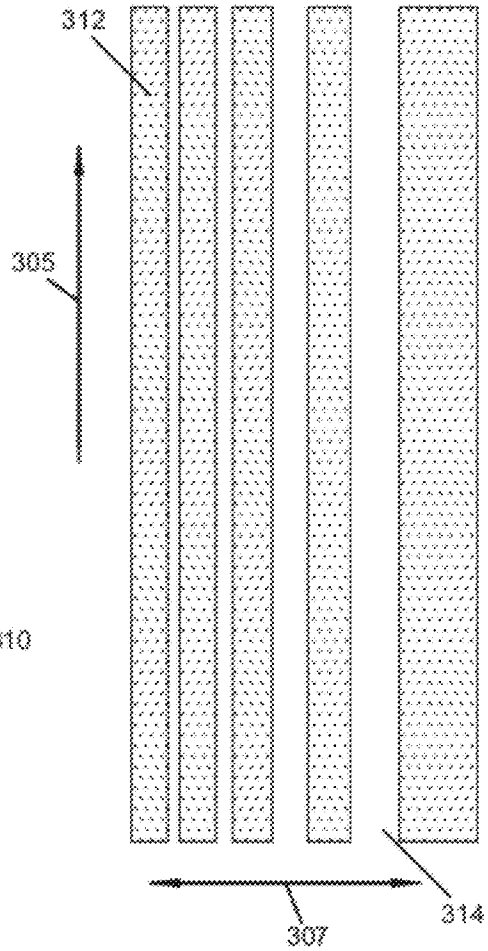
FIGS. 4-9 are top views of exemplary configurations of a mixing partition.
Figure 5:
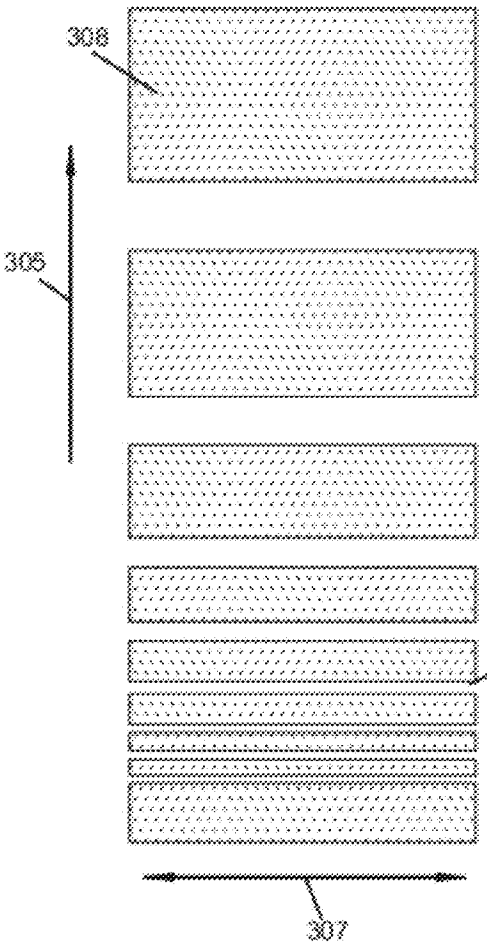

FIG. 5 shows a mixing partition 308 having eight different cross web rectangular openings 310 having six different sizes. FIG. 6 shows a mixing partition 312 having four down web rectangular openings 314, each having an unequal area compared to the others. The size of the openings increases moving across the mixing partition 312 in the cross web direction.

The mixing partitions 300, 308 and 312 shown in FIGS. 4 to 9 can be constructed from individual rectangular pieces spaced to provide the rectangular openings shown.

Figure 7:
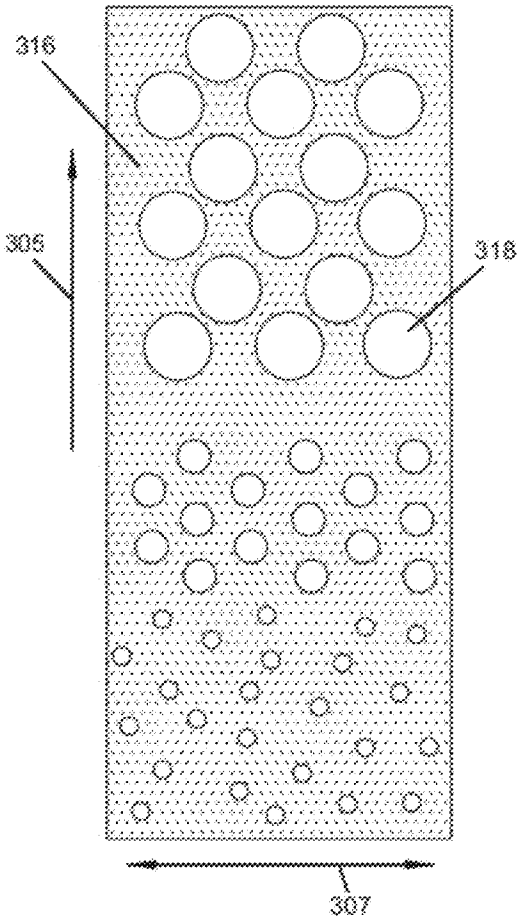
Figure 8:
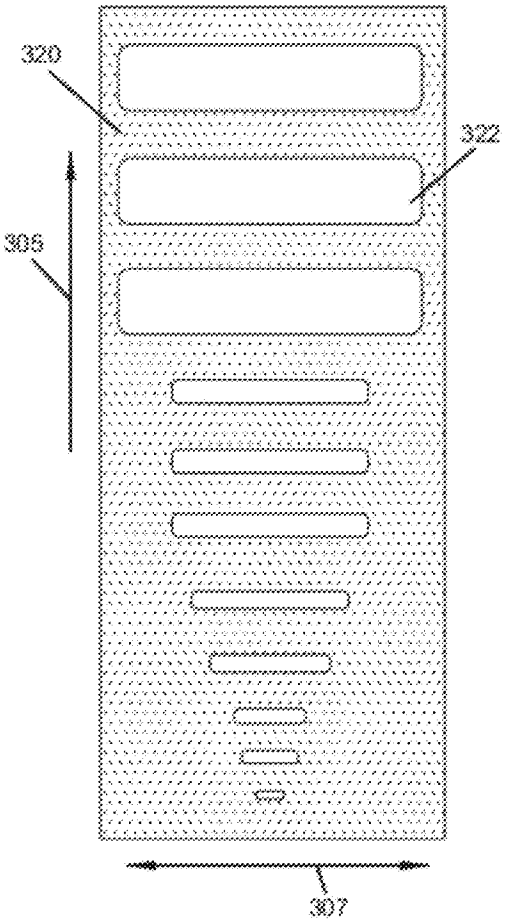
Figure 9:
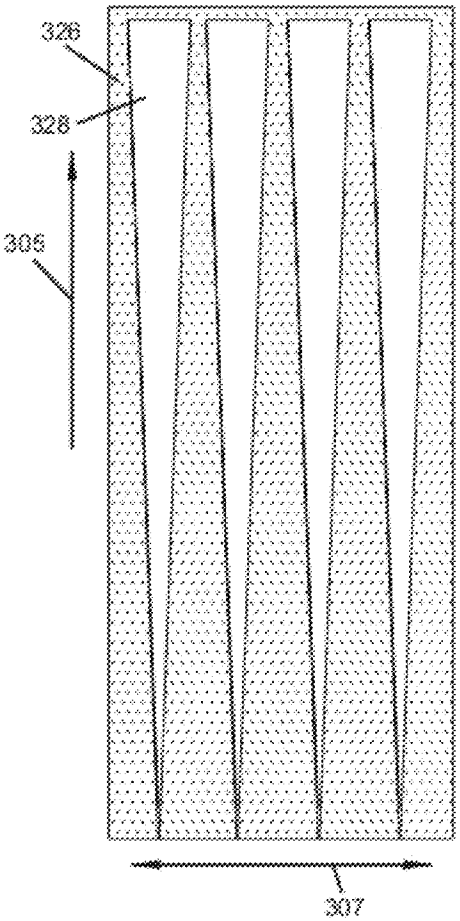

FIG. 7 shows a mixing partition 316 having circular openings 318. Three different sizes of circular openings are present in the mixing partition 316, where the size of the openings increases in the down web direction. FIG. 8 shows a mixing partition 320 having rectangular openings 322 that are longer in the cross web direction and do not extend over the entire width of the mixing partition. The size of the rectangular openings increases in the down web direction. FIG. 9 shows a mixing partition 326 having four equal wedge-shaped openings 328 that are long in the down web direction and widen in the down web direction. FIGS. 7 to 9 show mixing partitions 316, 320 and 326 that can be formed from a single piece of base material with openings provided therein.

Each partition configuration has a different effect on the mixing that occurs between two flow streams in a two flow stream embodiment. In some mixing partition examples, the variation in the size or shape of the openings occurs in the down web direction. When openings are positioned at the proximal end, or upstream end, of the mixing partition, the opening will enable mixing of the furnishes towards the bottom of the web. Openings at the distal end or downstream end of the mixing partition provide mixing of the furnishes closer to the top of the web. The size or area of the openings controls the proportion of mixing of the furnishes within the depth of the web. For example, smaller openings provide less mixing of the two furnishes, and larger openings provide more mixing of the two furnishes.

Mixing partitions shown in FIGS. 4 to 9 are configured to provide a gradient in a thickness or z-direction of a web. In the medium or web the first surface and second surface define the thickness of the medium that ranges from 0.2 to 20 mm or 0.5 to 20 mm and the portion of the region is greater than 0.1 mm.

The mixing partition of FIG. 6 is one example that is configured to provide a gradient in the cross web direction as well as in a thickness region of the web. In various embodiments, different combinations of opening geometries, for example, rectangular or circular, may be used on the same mixing partition.

In various embodiments, the mixing partition is formed in many different ways and from a variety of materials. In some embodiments, the mixing partition is formed by machining a single piece of metal or from a single piece of plastic. In other embodiments, the mixing partition is formed using several different pieces. For example, to form the mixing partitions shown in FIGS. 4-6, several rectangular pieces could be positioned so that there is an open rectangular section or slot between them in the center of the mixing partition and spanning the cross web direction (in the case of FIGS. 4 and 5) or machine direction (in the case of FIG. 6). Variation in the widths of the rectangular pieces provides a nearly infinite degree of variation of number and the size of the openings.

Figure 10:
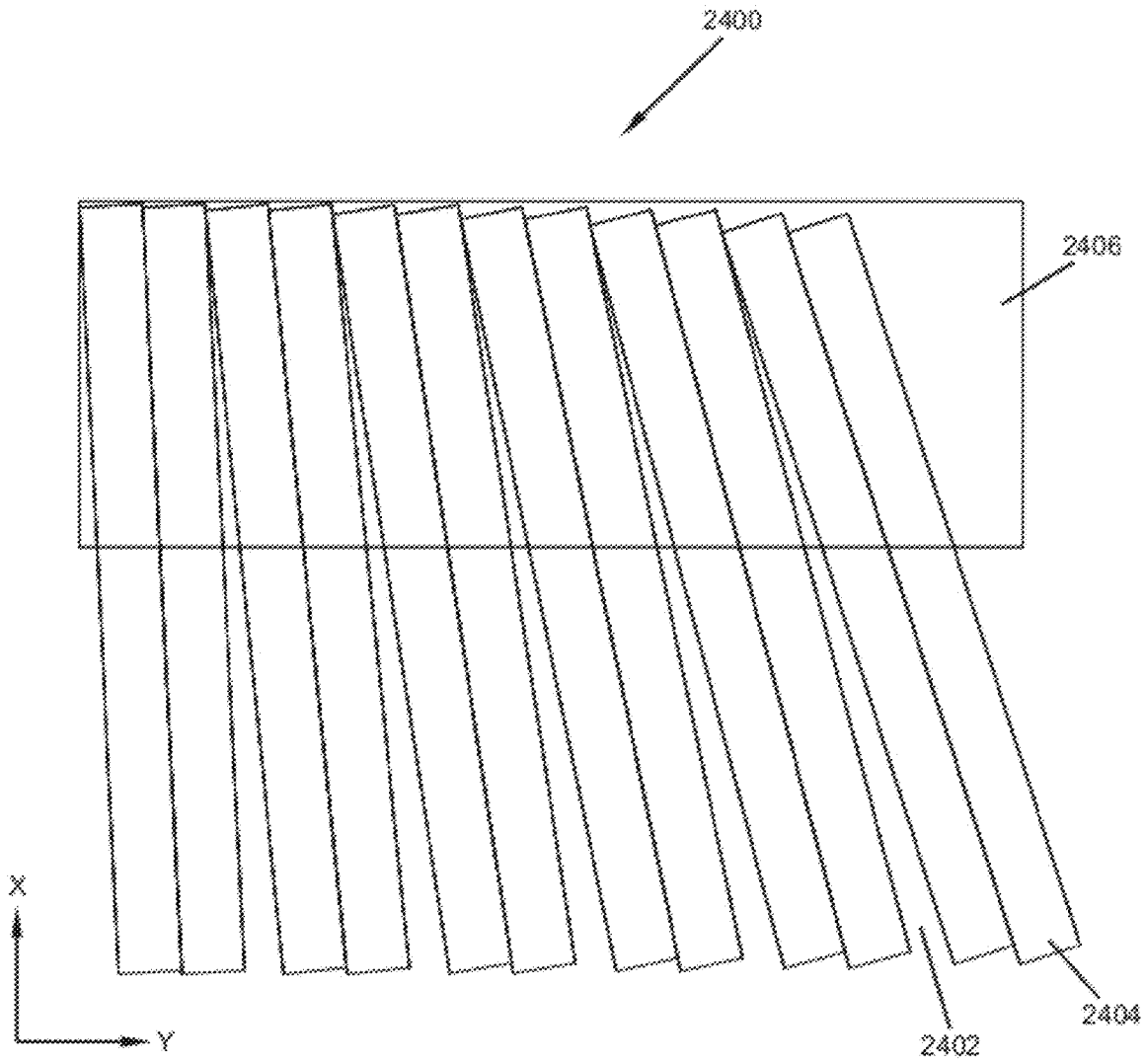
FIG. 10 is a top view of a fanned mixing partition.

FIG. 10 is a top view of a fanned mixing partition 2400 that accomplishes a gradient in the X-direction in a media, and also accomplishes a gradient in the thickness of a nonwoven web. The mixing partition 2400 defines openings 2402 that are present on one side of the mixing partition. The mixing partition 2400 includes a side rectangular piece 2406 which blocks the other half of the receiving area, and does not allow the top furnish to be deposited on that part of the receiving region. The mixing partition 2400 also includes several smaller rectangular pieces 2404 that extend in the cross web direction. The pieces 2404 are positioned in a fanned layout, so that openings 2402 are defined are wedge shaped. As a result, more of the furnish from the top source is deposited near the outer edge of the nonwoven web than towards the center.

In some embodiments, the mixing partition configurations described herein have a vertical portion extending down from the openings in the mixing partition towards the receiving region. The vertical portion may also extend at an angle to a vertical plane.

In some embodiments, the enclosed mixing partition configurations described herein include one or more weirs. A weir, in the context of the instant invention, is an overflow dam or barrier across one or more mixing partition features, generally extending in the cross web direction on the interior of the enclosed mixing partition. Where employed, a weir is generally, though not always, attached to one or more cross web mixing partition features between openings therein. In some embodiments, the weir allows at least a portion of the fluid flow stream to flow over the top thereof, while causing some degree of pooling of the fluid on the upstream side of the weir. The pooling, in turn, provides for an increased uniformity of fluid flow as the fluid flow stream traverses an opening and as it flows over the weir toward the downstream side of the enclosed mixing partition. Increased uniformity in flow through an opening in the mixing partition provides for a greater cross web uniformity of the gradient, where such uniformity is desired. The shape and placement of the weir is not particularly limited, and one of skill will understand that the particular features of the weir will be designed to provide a desired flow pattern within the enclosed mixing partition. In some embodiments where the enclosed mixing partition has cross web openings, the weir is a simple raised feature traversing the cross web direction of the mixing partition and situated at the upstream edge of an opening. In other embodiments, the weir is placed elsewhere on the mixing partition, for example partway between openings; or at the downstream edge of an opening. In some embodiments, the weir is a raised feature that is tilted or angled towards the upstream end of the mixing partition. In some embodiments, the weir is a vertical protrusion. In some embodiments, the weir is engineered to have a specific shape, such as a V-shape or a curved shape, where the concave portion of the V or curve faces upstream. In some embodiments, the weir has a shape that varies over the cross web direction, such as a weir that protrudes further into the enclosed mixing partition near the center thereof. In embodiments, the weir is a raised feature protruding about 0.2 cm to 10 cm above the plane of the mixing partition into the enclosure. In other embodiments, the weir protrudes about 0.5 cm to 5 cm; in still other embodiments, the weir protrudes about 1 cm to 3 cm. In embodiments, there is at least one weir within the enclosed mixing partition; in other embodiments, there is a plurality of weirs within the enclosed mixing partition. Where there is a plurality of weirs, the weirs are the same shape and size, or are of varying shapes and/or sizes.

c. Additional Features of the Enclosed Mixing Partition

In some embodiments, applied pressure is provided to the enclosed mixing partition from sources other than or in addition to a pressurized flow stream of furnish into the enclosed mixing partition. For example, compressed air, hydraulically generated pressure, or other known means of applying pressure are employed in some embodiments in conjunction with the enclosed mixing partition of the invention. In embodiments, two or more sources of applied pressure are provided to the enclosed mixing partition. For example, in some embodiments a pressurized flow stream of furnish, such as pressurized flow stream 109 of FIG. 3, is augmented by a source of pressure applied within enclosure 160 such as compressed air or hydraulic pressure. Typically, though not always, if the pressure source is not a pressurized flow stream of furnish, the applied pressure is provided by a source connected directly to the enclosure surrounding the mixing partition. Many different types of pumps, such as mechanical pumps, are suitable for applying such pressure. In embodiments, application of compressed air to the enclosure is used for applying pressure to the furnish as it traverses the mixing partition. The means of applying pressure is not limited with respect to the apparatus, that is the enclosure, or processes of the invention. The appropriate source of pressure is selected based on the equipment employed in conjunction with the mixing partition, that is, the source of furnish and configuration of the mixing partition relative to the furnish source.

In one embodiment, in order to apply pressure to the furnish as it traverses the mixing partition, the furnish within the mixing partition area and proximal to the openings in the mixing partition is in a space that is generally enclosed except for an inlet for the source of furnish and the openings associated with the mixing partition, optionally a separate opening for applying pressure to the enclosure, and optionally a separate valve to relieve excess pressure or drain excess furnish from the enclosed area. Several configurations of enclosed spaces are possible, as will be appreciated with further discussion of representative embodiments described below. These representative embodiments are not limiting in any way, and are intended to be illustrative of some of the useful configurations that increase line speed in forming the gradient media of the invention.

Figure 11:
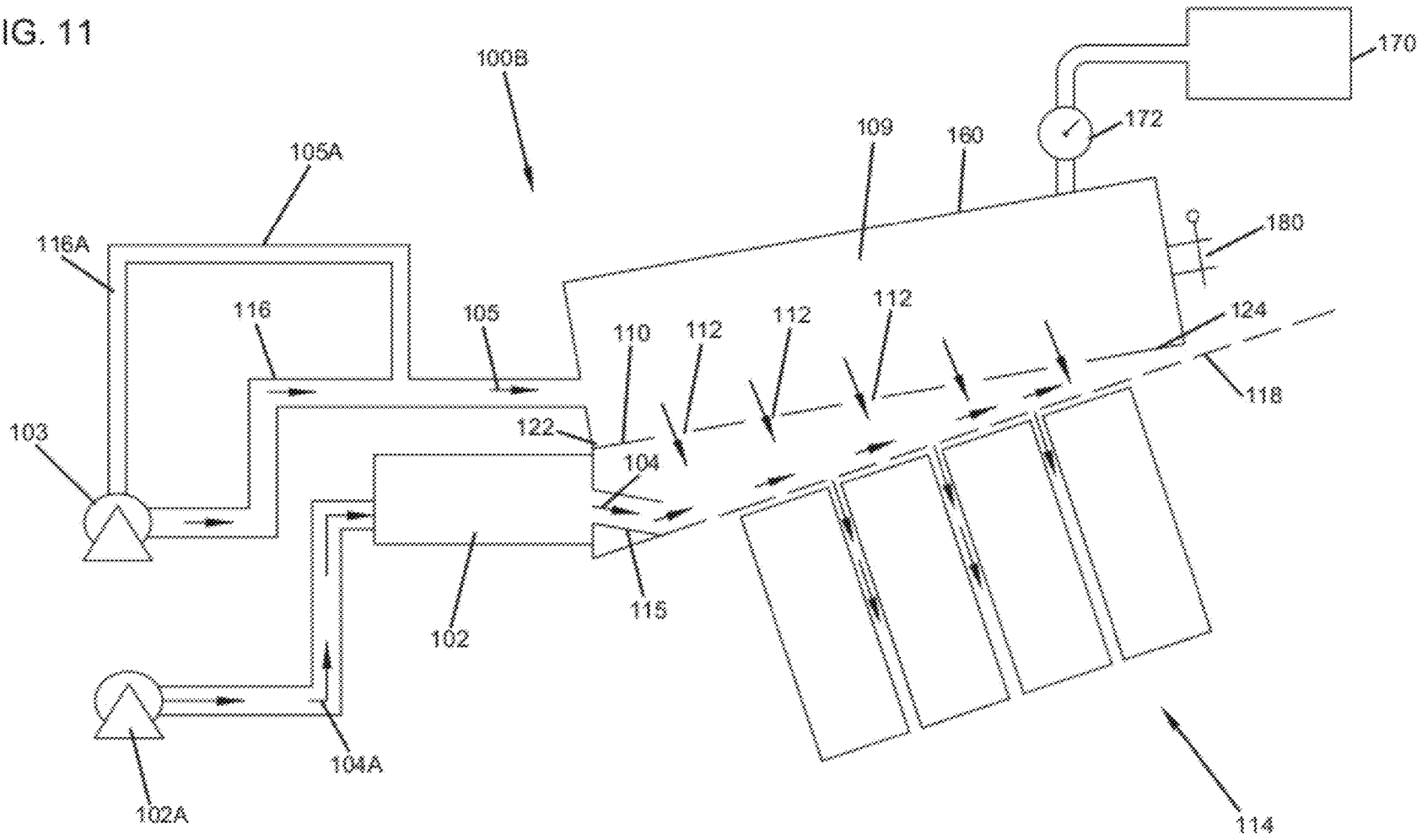
FIG. 11 is a schematic cross-sectional view of another embodiment of an apparatus for forming a nonwoven web.

An embodiment of an apparatus having an enclosed mixing partition is shown in FIG. 11. FIG. 11 shows a schematic cross-sectional view of a modified inclined papermaking apparatus 100B. Source 102A supplies flow stream 104A to headbox 102, which in turn supplies flow stream 104 to the area above receiving area 114. Feed tube 115 carries flow stream 104 away from the source 102 and onto wire guide 118 that is conveyed across and above the receiving region 114. Source 103 is configured as an apparatus that supplies flow stream 105 to feed tube 116, wherein flow stream 105 includes a pressure feedback flow 105A that loops back to source 103 by feedback tube 116A. Feedback flow 105A ensures that no applied pressure is added to stream 105 as it leaves source 103 through feed tube 116. Mixing partition 110 is present at the distal end of feed tube 116, and is enclosed by enclosure 160 having openings 112 defined therein. Feed tube 116 carries flow stream 105 away from source 103. Flow stream 105 proceeds into enclosure 160 at proximal end 122 and flows generally toward distal end 124.

Enclosure 160 is pressurized by a pressure source 170 that is attached to, and is in fluid communication with, enclosure 160. The pressure source 170 is controlled by a control device 172. Pressure source 170 applies a pressure to the enclosure 160. In some embodiments, pressure source 170 is a compressed air tank, and control device 172 is a gas pressure regulator. In some other embodiments, pressure source 170 is a hydraulic pump. When flow stream 105 enters enclosure 160, it becomes a pressurized flow stream 109. Also attached to, and in fluid communication with, enclosure 160 is valve 180. In embodiments, valve 180 is employed to return a portion of the furnish within the enclosure 160 to source 103 (path between valve 180 and source 103 is not shown). In other embodiments, valve 180 is employed as an additional opening through which a portion of the pressurized flow stream 109 is deposited onto wire conveyor 118. Thus, some or all of pressurized flow stream 109 descends through openings 112, as urged by pressure applied to enclosure 160 by pressure source 170 and further as permitted by the dimensions of the openings 112, onto the wire conveyor 118 and across the area above the receiving region 114. In embodiments, pressurized flow stream 109 flows through openings 112 faster than the same flow stream would flow through the same openings in the absence of enclosure 160. The faster rate of flow in turn enables flow stream 104 and wire guide 118 to proceed at higher rates, while achieving the same extent of mixing of the two flow streams as is achieved using the slower speeds necessitated by using apparatus 100B in the absence of enclosure 160 and pressure source 170. Thus, the line speed of apparatus 100B in forming the gradient media of the invention is increased as enabled by the pressurized flow stream 109 in conjunction with enclosure 160. In some such embodiments, source 102 is also a pressurized source.

Figure 12:
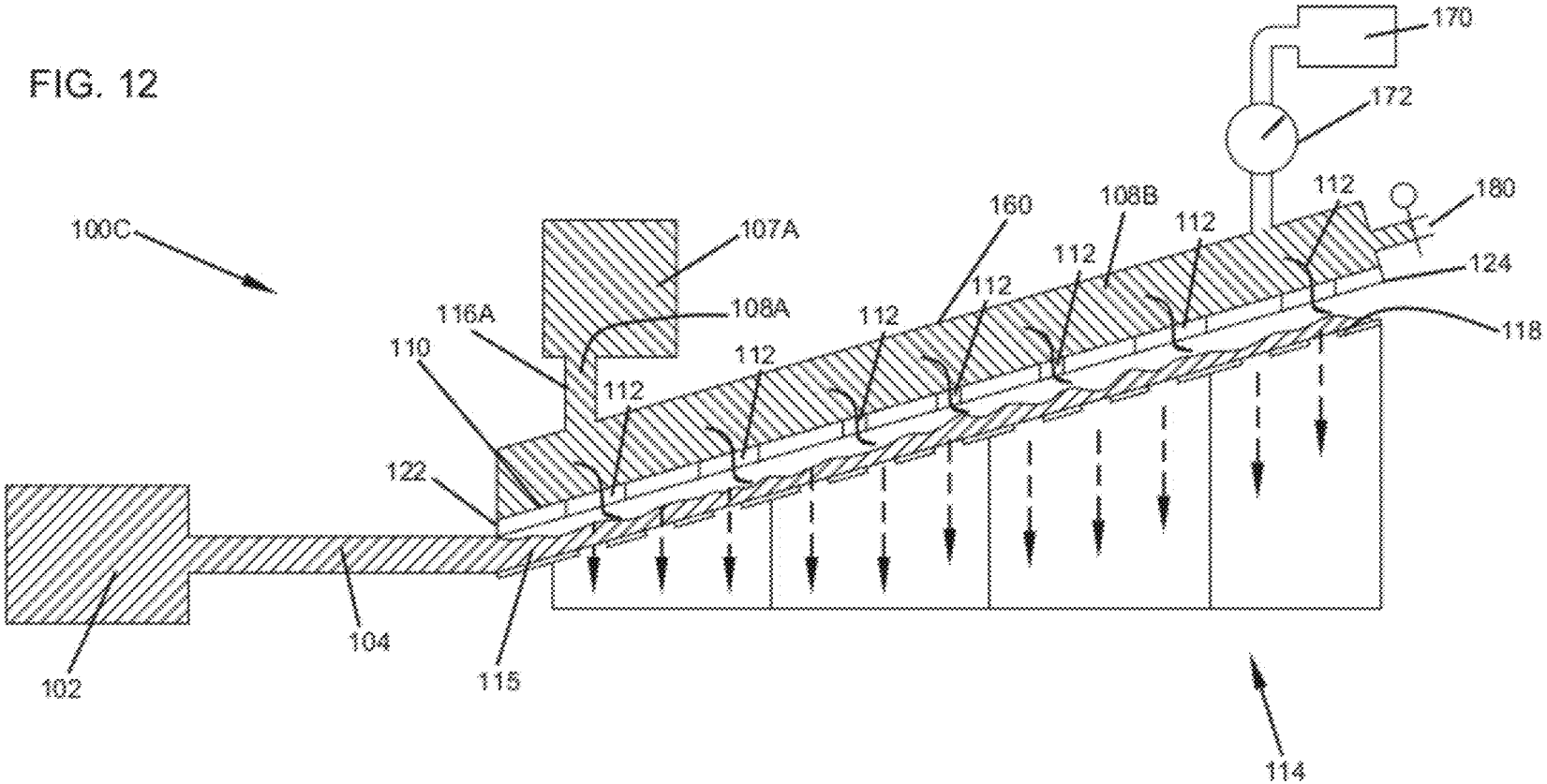
FIG. 12 is a schematic cross-sectional view of yet another embodiment of an apparatus for forming a nonwoven web.

Another alternate embodiment of an apparatus having an enclosed mixing partition is shown in FIG. 12. FIG. 12 shows a schematic cross-sectional view of a modified inclined papermaking apparatus 100C with two sources 102, 107A and a mixing partition 110 enclosed by enclosure 160. Source 102 supplies flow stream 104 via feed tube 115 and onto wire guide 118 above the receiving region 114. Source 107A is configured as a headbox or another apparatus that supplies flow stream 108A from above enclosure 160 via feed tube 116A. Feed tube 116A carries flow stream 108A away from source 107A and into enclosure 160. Enclosure 160 encloses mixing partition 110 that defines openings 112. The mixing partition 110 has a proximal end 122 and a distal end 124. Flow stream 108A enters enclosure 160 between proximal end 122 and distal end 124. The exact location of entry of flow stream 108A into enclosure 160 can be modified and is not particularly limited by the location illustrated in FIG. 12. In some embodiments, source 107A further includes a source of pressure, thereby delivering a pressurized flow stream 108A into enclosure 160. In other embodiments, gravitational force alone is employed to urge flow stream 108A into enclosure 160.

Enclosure 160 is further pressurized by a pressure source 170 that is attached to, and is in communication with, enclosure 160. Pressure source 170 is controlled by a control device 172. Pressure source 170 of FIG. 12 is any of the same pressure sources described in FIG. 11. Also attached to, and in communication with, enclosure 160 is valve 180. Valve 180 of FIG. 12 is employed in any of the ways valve 180 of FIG. 11 is employed. Flow stream 108A is pressurized at least within enclosure 160 and becomes pressurized flow stream 108B. At least some portion of pressurized flow stream 108B descends through openings 112, as urged by pressure applied to enclosure 160 by pressure source 170 and, in some embodiments additionally by source 107A, and further as permitted by the dimensions of the openings 112, onto wire guide 118 immediately above the receiving region 114. As a result, pressurized flow stream 108B mixes and blends with flow stream 104. In embodiments, pressurized flow stream 108B flows through openings 112 faster than the same flow stream would flow through the same openings in the absence of enclosure 160. The faster rate of flow in turn enables flow stream 104 and wire guide 118 to proceed at higher rates across receiving region 114, while achieving the same extent of mixing of the two flow streams as is achieved using the slower speeds necessitated by using apparatus 100C in the absence of enclosure 160 and pressure source 170. Thus, the line speed of apparatus 100C in forming the gradient media of the invention is increased as enabled by the pressurized flow stream 108B in conjunction with enclosure 160. In some such embodiments, source 102 is also a pressurized source.

It will be appreciated that there are several related embodiments of apparatuses 100B and 100C. For example, in some alternative embodiments of apparatus 100B and 100C, pressure source 170 does not have a control device 172. In other alternative embodiments of apparatus 100B and 100C, there is no valve 180. In yet another alternative embodiment of apparatus 100C, there is no pressure source 170 or control device 172; thus flow stream 108A and flow stream 108B have an applied pressure supplied entirely by source 107A.

It will be appreciated that there are several additional related embodiments of apparatuses 100A, 100B, and 100C. In some embodiments, a portion of the mixing partition 110 is outside of enclosure 160. In some such embodiments, a flow stream enters enclosure 160, and overflow from enclosure 160 exits enclosure 160, for example, via valve 180 in apparatuses 100B and 100C, and is applied to a second mixing partition (not shown) that is not enclosed. In other such embodiments, an unenclosed mixing partition is followed by an enclosed mixing partition. Other embodiments include enclosed and unenclosed mixing partitions having different sources of furnish, and two or more enclosed mixing partitions having differential pressure within the enclosures, different sources of furnish, or both.

In some embodiments, the enclosure 160 is built into an apparatus such that it is integral to the overall media forming system. In other embodiments, the enclosure 160 is retrofitted to an existing apparatus. In some such embodiments, enclosure 160 includes mixing partition 110. In other embodiments, mixing partition 110 is a part of the apparatus and the enclosure 160 is retrofitted on top of mixing partition 110. In some embodiments, enclosure 160 is detachable from the apparatus so that pressurized and non-pressurized use of mixing partition 110 is possible. In some such embodiments, mixing partition 110 is also separately removable. In other embodiments, mixing partition 110 is integral to enclosure 160 and the enclosure 160 including mixing partition 110 is detachable as a single structure.

Figure 13:
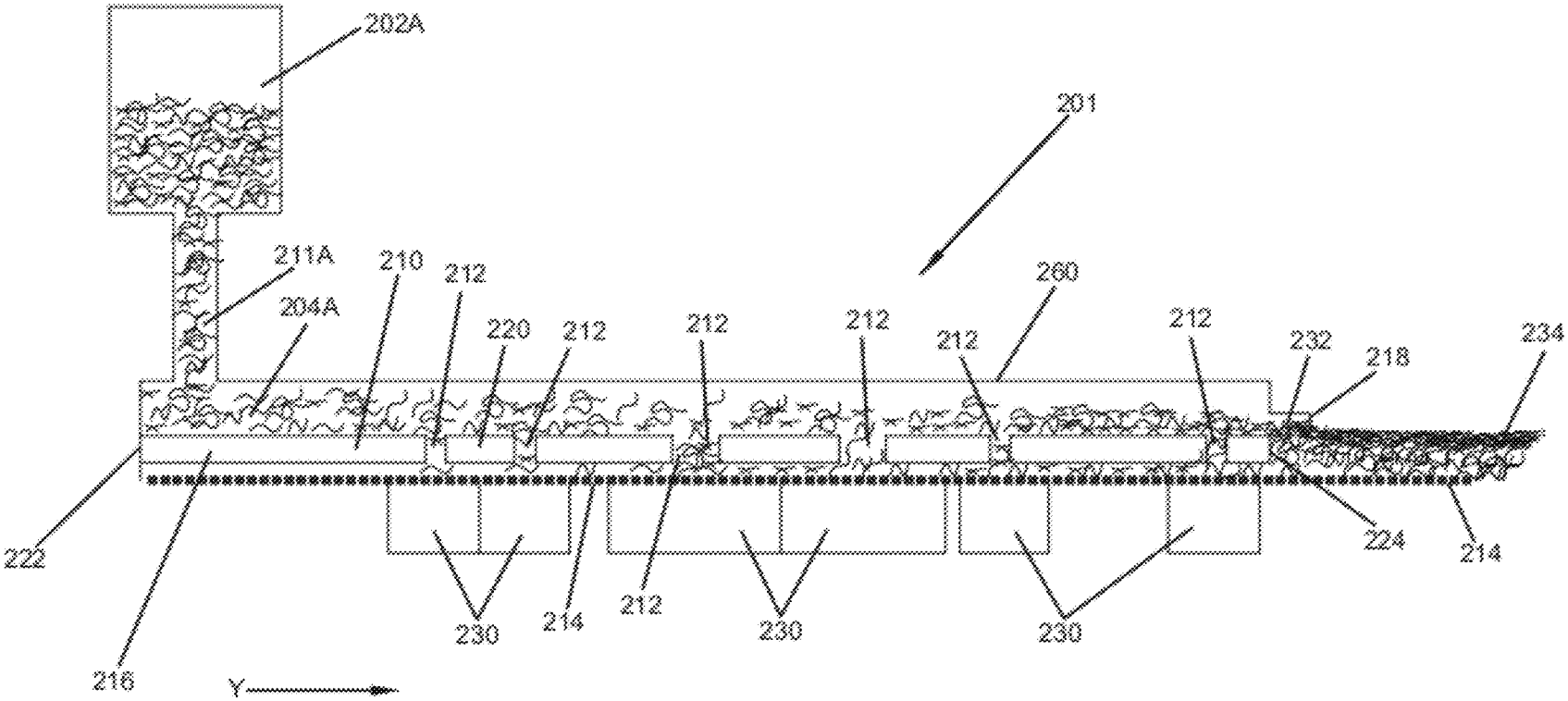
FIG. 13 is a schematic cross-sectional view of yet another embodiment of an apparatus for forming a nonwoven web.

FIG. 13 shows an alternate embodiment of an apparatus having an enclosed mixing partition. FIG. 13 shows an apparatus 201 for forming a continuous gradient media where a single source of furnish is used in combination with an enclosed mixing partition. A pressurized source 202A provides a pressurized flow stream 204A of a furnish which includes at least two different fibers, such as different fiber sizes or fibers of different chemical compositions. The pressurized flow stream 204A is provided to the mixing partition 210 via a feed tube 211A. The mixing partition 210 includes openings 212 and is surrounded by enclosure 260. In one embodiment, the mixing partition has an initial portion 216 without openings and a second portion 220 with openings 212. The mixing partition has a proximal end 222 nearest to the source and a distal end 224 farthest from the source. The sizes of the openings 212 in the mixing partition 210 are configured to select, or sieve, for the different fiber sizes in the furnish. Portions of the pressurized flow stream 204A pass through the openings 212 in the mixing partition 210 and are deposited on wire guide 214. Drainage boxes 230 collect or extract water and other solvents by gravity or other extraction means. An un-sieved portion 232 of the pressurized flow stream 204A is deposited on the gradient medium at the end 234 of the section of the apparatus 201 via valve 218. Further processing can take place subsequent to deposition of unsieved portion 232, such as further drainage, drying of the gradient web, etc.

It will be appreciated that there are several alternative embodiments of apparatuses 201. For example, in some alternative embodiments of apparatus 201, an additional source of pressure is attached to enclosure 260, such as pressure sources 170 described above in conjunction with FIGS. 11 and 12. In some such embodiments, the additional pressure source is provided with a control device to regulate pressure, such as control devices 172 described above in conjunction with FIGS. 11 and 12. In other embodiments a constant pressure is applied to enclosure 260 during operation of apparatus 201. In some alternative embodiments of apparatus 201, there are one or more additional valves to relieve excess pressure, recirculate unsieved portions of furnish, or release unsieved portions of furnish onto wire guide 214. In other embodiments of apparatus 201 there is no valve 218. In some such embodiments, one or more openings 212 near distal portion 224 of mixing partition 210 are not configured to provide sieving of the one or more fibers in pressurized flow stream 204A and instead are openings of sufficient size to allow the traverse of all fibers.

In some alternative embodiments of apparatus 201, a portion of the mixing partition 210 is outside of enclosure 260, wherein flow stream 204A enters enclosure 260, and overflow from enclosure 260 exits enclosure 260 via valve 218, and is applied to a second mixing partition that is not enclosed. In other such embodiments, a non-enclosed mixing partition is followed by an enclosed mixing partition. Other embodiments are also possible. In some alternative embodiments of apparatus 201, a source of furnish similar to 202A is employed, except that the source is not pressurized. In such embodiments, pressure is applied to urge the furnish through openings 212 within enclosure 260 by a separately supplied source of pressure such as those described above in conjunction with FIGS. 11 and 12.

In some alternative embodiments of apparatus 201, source 202A is connected to enclosure 260 in a different location that that represented in FIG. 13; that is, instead of being located near proximal end 222 of mixing partition 210, source 202A is located over openings 212, or even closer to distal end 224 of mixing partition 210. In some alternative embodiments of apparatus 201, there is air space within enclosure 260; in other embodiments there is no air space within enclosure 260. Any of these alternative embodiments are useful in combinations of one or more thereof. Several other alternative arrangements are possible in addition to those mentioned herein.

In some alternative embodiments of apparatus 201, the enclosure 260 is built into an apparatus 201 such that it is integral to the overall media forming system. In other embodiments, the enclosure 260 is retrofitted to an existing apparatus. In some such embodiments, enclosure 260 includes mixing partition 210. In other embodiments, mixing partition 210 is a part of the apparatus and the enclosure 260 is retrofitted on top of mixing partition 210. In some embodiments, enclosure 260 is detachable from the apparatus so that pressurized and non-pressurized use of mixing partition 210 is possible. In some such embodiments, mixing partition 210 is also removable separately; in other embodiments, mixing partition 210 is integral to enclosure 260 and the enclosure 260 including mixing partition 210 is detachable as a single entity. Any of these alternative embodiments are useful in combinations of one or more thereof. Several other alternative arrangements are possible in addition to those mentioned herein.

Figure 14:
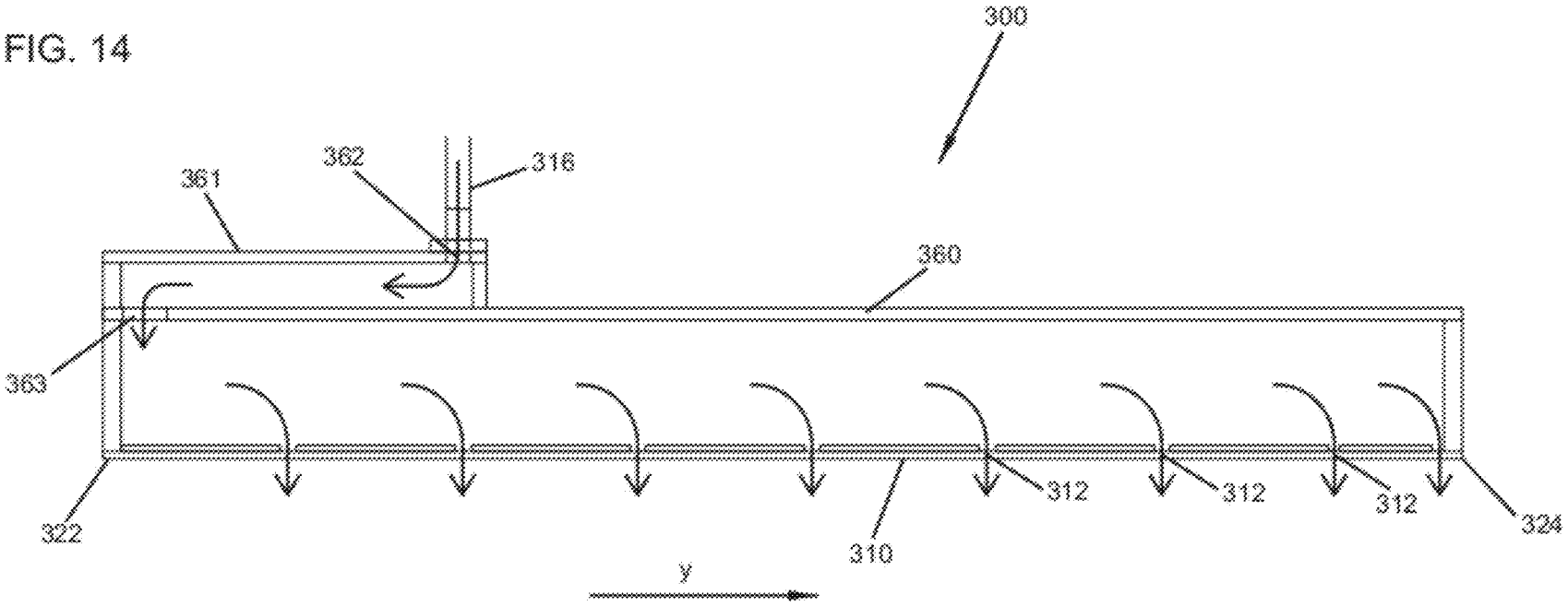
FIG. 14 is a side view of an embodiment of an enclosed mixing partition assembly.

FIG. 14 shows an alternative arrangement of an enclosed mixing partition, isolated from the apparatus for forming the gradient media of the invention in order to show pertinent detail of a side view of a mixing partition assembly 300. Mixing partition assembly 300 includes mixing partition 310 having openings 312 and enclosure 360. Mixing partition assembly 300 is arranged to show the general direction of a flow of furnish across mixing partition 310, indicated by the arrow labeled Y, when the assembly 300 is present as part of the apparatus for forming the gradient media of the invention. Proximal end 322 and distal end 324 of the assembly 360 correspond to proximal end 122 and distal end 124 of e.g. FIGS. 1-3 and 11-13 when assembly 360 is included as part of an apparatus for forming gradient media. The mixing partition 310, openings 312, and enclosure 360 generally are configured as in any of the foregoing embodiments associated with FIGS. 1-3 and 11-13 and variations thereof as described, and in general are designed to work in substantially the same way to form the gradient media of the invention.

Enclosure 360 has attached thereto a flow distribution chamber 361, which is attached to the enclosure 360 at a position directly above mixing partition 310 and near proximal end 322. Flow distribution chamber 361 is configured and adapted for receiving a flow stream of furnish, which in some embodiments is a pressurized flow stream. Flow distribution chamber 361 has one or more inlets 362, and a plurality of openings 363 at the bottom thereof. The one or more inlets 362 are in fluid communication with feed tube 316, wherein feed tube 316 provides a pressurized or unpressurized flow stream of furnish from one or more sources to chamber 361. Where there are a plurality of inlets 362, feed tube 316 is split into multiple tubes at a location between the one or more sources and the inlets 362. Openings 363 are in fluid communication with enclosure 360. Openings 363 are generally positioned near proximal end 322. The one or more inlets 362 are not particularly limited as to position; however, in some embodiments they are located on the top of chamber 361 and distal to openings 363. As configured in FIG. 14, furnish will flow from feed tube 316 into chamber 361 via the one or more inlets 362, and flow counter to the horizontal direction of flow represented by the arrow Y, toward proximal end 322. At proximal end 322, the furnish will pass through openings 363 into enclosure 360 and onto mixing partition 310.

Figure 15:
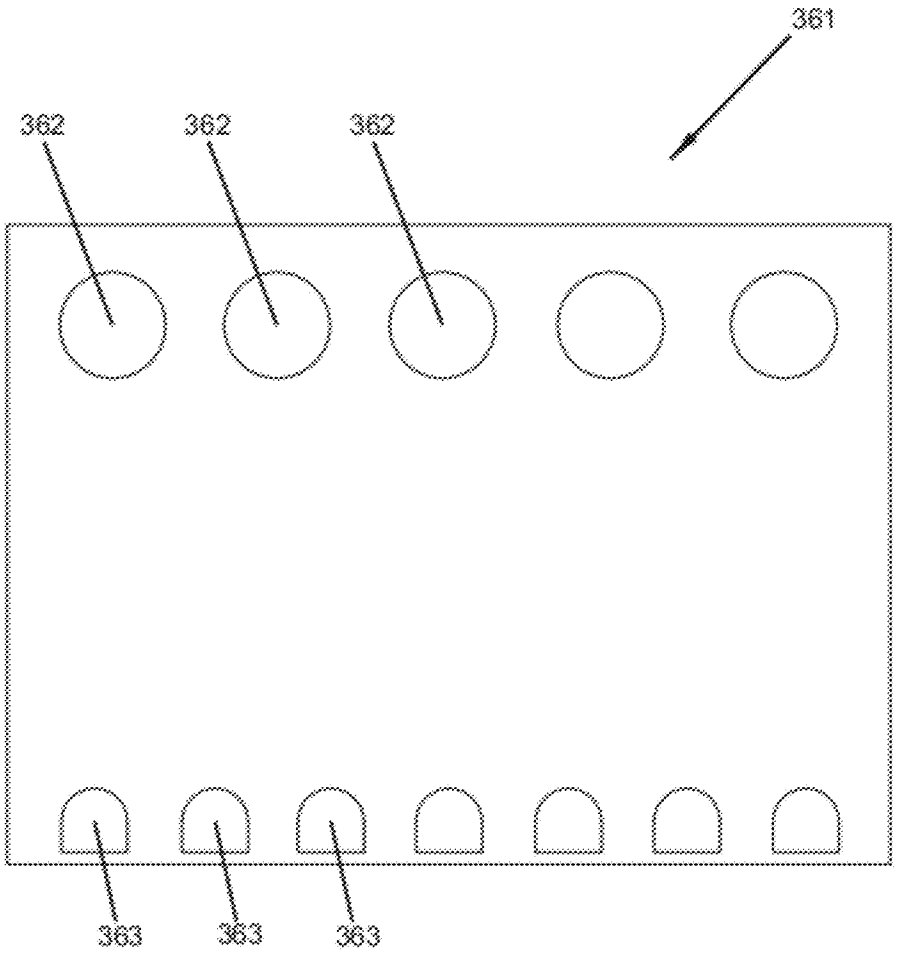
FIG. 15 is a schematic top view of a portion of the assembly of FIG. 14.

In somewhat greater detail, FIG. 15 shows a top view of flow distribution chamber 361, wherein the relative positions of the inlets 362 and openings 363 as shown in FIG. 14 are shown. In the embodiment shown, there are five inlets 362 and seven semi-circular openings 363. It will be understood that the shape, number, and size of inlets 362 and openings 363 are not particularly limited and are configured, in various embodiments, to achieve an even distribution of furnish as it flows across the chamber 361 toward proximal end 322, and thus deliver a uniform distribution of furnish flow to mixing partition 310 within enclosure 360.

It will further be appreciated that the flow distribution chamber 361 mitigates some portion of the downward momentum of the flow stream where the source of furnish is a pressurized source. In some embodiments, when a pressurized flow of furnish is applied directly on top of the mixing partition 310, the pressurized flow causes a larger than desired proportion of the furnish to pass through the first opening in the mixing partition. The flow distribution chamber 361 thus provides for even flow distribution of the furnish in both the cross-web direction and the down-web direction (machine direction). It will further be appreciated that flow distribution chamber 361 will achieve this even flow distribution with or without the enclosure 360—that is, distribution chamber 361 is in some embodiments a standalone apparatus that is situated to dispense furnish onto an un-enclosed mixing partition of the invention.

d. Processes

In one embodiment, a method of making a nonwoven web includes dispensing a first fluid stream from a first source, wherein the fluid stream includes fiber. An apparatus used in this method has an enclosed mixing partition downstream from the first source and the enclosed mixing partition is positioned between two flow paths from the first source. The flow paths are separated by the mixing partition, which defines one or more openings in the mixing partition that permit fluid communication from at least one flow path to another. The method further includes collecting fiber on a receiving region situated proximal and downstream to the source. The receiving region is designed to receive the flow stream dispensed from the source and form a wet layer by collecting the fiber. A further step of the method is drying the wet layer to form the nonwoven web.

In another embodiment, a method of making a nonwoven web includes providing a furnish from a source, the furnish including at least a first fiber, and dispensing a stream of the furnish from an apparatus for making a nonwoven web. The apparatus has an enclosed mixing partition downstream from a source of the stream, and the mixing partition defines at least one opening to allow passage of at least a portion of the stream. The method further includes collecting fiber passing through the opening on a receiving region situated downstream from the source, collecting a remainder of fiber on the receiving region at a downstream portion of the mixing partition, and drying the wet layer to form the nonwoven web.

In another embodiment, a method of making a nonwoven web includes providing a furnish from a source, the furnish including at least a first fiber, and dispensing the furnish across a mixing partition downstream from the source. The mixing partition defines two or more openings configured to allow passage of at least a portion of the furnish. The mixing partition includes an enclosed region surrounding at least a portion of the mixing partition and adapted to apply a pressure to the furnish. The method further includes applying a pressure within the enclosed region to urge the furnish through one or more of the openings in the mixing partition, collecting fiber from the furnish passing through the two or more openings on a receiving region situated downstream from the source to form a wet layer on the receiving region, and drying the wet layer to form the nonwoven web.

In embodiments, relative to the speed of media formation where no pressure is applied to the fluid dispensed across the mixing partition, media formation speeds of 1.5 to 10 times higher, 2 to 100 times higher, or even as much as 10 to 1000 times higher can be achieved when pressure is applied to the furnish as it traverses the mixing partition. Line speeds of about 4-10 meter/min, or about 10-100 meter/min, or about 100-500 meter/min, or about 500-1000 meter/min, or even as high as about 1000-2000 meter/min, or in some embodiments higher than 2000 meter/min, are achieved by employing applied pressure in conjunction with the mixing partition in the apparatuses of the invention to form the gradient media of the invention.

Furnishes that are sufficiently dilute facilitate the mixing of the fibers from the flow streams in the mixing portion of the receiving region. In a furnish, fiber is dispersed in fluid, such as water, and optional additives. In one embodiment, one or both of the furnishes is an aqueous furnish. In an embodiment the weight percent (wt. %) of fiber in a furnish can be in a range of about 0.005 to 1 wt. %. In an embodiment the weight % of fiber in a furnish can be in a range of about 0.01 to 0.1 wt. %. In an embodiment the weight % of fiber in a furnish can be in a range of about 0.03 to 0.09 wt. %. In an embodiment, the weight % of fiber in an aqueous solution can be in a range of 0.02 to 0.05 wt. %. In one embodiment, at least one of the flow streams is a furnish having a fiber concentration of less than about 20 grams of fiber per liter.

Water, or other solvents and additives are collected in drainage boxes under the receiving region. The collection of water and solvents may be aided by gravity, vacuum extraction or other drying means to extract surplus fluids from the receiving region. Additional intermixing and blending of the fibers may occur depending on the fluid collection means, such as vacuum, applied to drainage boxes. For example, a stronger level of vacuum extraction of fluids from the receiving region can make it more likely that a media will have differences between the two sides, which is also referred to as two-sidedness. Also, in areas where the degree of water removal is reduced, such as by selectively closing or turning off drainage boxes, increased intermixing of the two flow streams will result. Back pressure can even be generated that causes the first flow stream to pass upward through the openings in the enclosed mixing partition and mix to a larger degree with the pressurized flow stream.

In one wet laid processing embodiment, the gradient medium is made from an aqueous furnish including a dispersion of fibrous material and other components as needed in an aqueous medium. The aqueous liquid of the dispersion is generally water, but may include various other materials such as pH adjusting materials, surfactants, defoamers, flame retardants, viscosity modifiers, media treatments, colorants and the like. The aqueous liquid is usually drained from the dispersion by conducting the dispersion onto a screen or other perforated support retaining the dispersed solids and passing the liquid to yield a wet media composition. The wet composition, once formed on the support, is usually further dewatered by vacuum or other pressure forces and further dried by evaporating the remaining liquid. Options for removal of liquid include gravity drainage devices, one or more vacuum devices, one or more table rolls, vacuum foils, vacuum rolls, or a combination thereof. The apparatus can include a drying section proximal and downstream to the receiving region. Options for the drying section include a drying can section, one or more IR heaters, one or more UV heaters, a through-air dryer, a transfer wire, a conveyor, or a combination thereof.

After liquid is removed, thermal bonding can take place where appropriate by melting some portion of the thermoplastic fiber, resin or other portion of the formed material. Other post-treatment procedures are also possible in various embodiments, including resin curing steps. Pressing, heat treatment and additive treatment are examples of post-treatment that can take place prior to collection from the wire. After collection from the wire further treatments such drying and calendaring of the fibrous mat may be conducted in finishing processes.

One specific machine that can be modified to include the mixing partition described herein is the DELTAFORMER™ machine (available from Glens Falls Interweb, Inc. of South Glens Falls, N.Y.), which is a machine designed to form very dilute fiber slurries into fibrous media. Such a machine is useful where, e.g. inorganic or organic fibers with relatively long fiber lengths for a wet-laid process are used, because large volumes of water must be used to disperse the fibers and to keep them from entangling with each other in the furnish. Long fiber in wet laid process typically means fiber with a length greater than 4 mm, that can range from 5 to 10 mm and greater. Nylon fibers, polyester fibers (such as Dacron®), regenerated cellulose (rayon) fibers, acrylic fibers (such as Orlon®), cotton fibers, polyolefin fibers (i.e. polypropylene, polyethylene, copolymers thereof, and the like), glass fibers, bicomponent fibers such as polyester/polyolefin core/sheath fibers, and abaca (Manila Hemp) fibers are examples of fibers that are advantageously formed into fibrous media using such a modified inclined papermaking machine. Other fiber types are also suitable and are not particularly limited.

The DELTAFORMER™ machine differs from a traditional Fourdrinier machine in that the wire section is set at an incline, forcing slurries to flow upward against gravity as they leave the headbox. The incline stabilizes the flow pattern of the dilute solutions and helps control drainage of dilute solutions. A vacuum forming box with multiple compartments aids in the control of drainage. These modifications provide a means to form dilute slurries into fibrous media having improved uniformity of properties, across the web when compared to a traditional Fourdrinier design.

In some embodiments of an apparatus for making a gradient web as described herein, there are four main sections: the wet section (illustrated in FIG. 3), the press section, the dryer section and the calendaring section.

In one embodiment of the wet section, mixtures of fibers and fluid are provided as a furnish after a separate furnish making process. The furnish can be mixed with additives before being passed onto the next step in the medium forming process. In another embodiment, dry fibers can be used to make the furnish by sending dry fibers and fluid through a refiner which can be part of the wet section. In the refiner, fibers are subjected to high pressure pulses between bars on rotating refiner discs. This breaks up the dried fibers and further disperses them in fluid such as water that is provided to the refiner. Washing and de-aeration can also be performed at this stage.

After furnish making is complete, the furnish can enter the structure that is the source of the flow stream, such as a headbox. The source structure disperses the furnish across a width loads it onto a moving wire mesh conveyor with a jet from an opening. In some embodiments described herein, two sources or two headboxes are included in the apparatus. Different headbox configurations are useful in providing gradient media. In one configuration, top and bottom headboxes are stacked right on top of each other. In other configuration, top and bottom headboxes are staggered somewhat. The top headbox can be further down the machine direction, while the bottom headbox is upstream.

In one embodiment, the jet is a fluid that urges, moves or propels a furnish, such as water or air. Streaming in the jet can create some fiber alignment, which can be partly controlled by adjusting the speed difference between the jet and the wire mesh conveyor. The wire revolves around a forward drive roll, or breast roll, from under the headbox, past the headbox where the furnish is applied, and onto what is commonly called the forming board.

The forming board works in conjunction with the mixing partition of the invention. The furnish is leveled and alignment of fibers can be adjusted in preparation for water removal. Further down the process line, drainage boxes (also referred to as the drainage section) remove liquid from the medium with or without vacuum. Near the end of the wire mesh conveyor, another roll often referred to as a couch roll removes residual liquid with a vacuum that is a higher vacuum force than previously present in the line.

EMBODIMENTS

1. First Embodiment

A first embodiment of the invention, either alone or in combination with any other embodiment or combination of embodiments listed in this section or elsewhere herein, contemplates an apparatus for making a nonwoven web, the apparatus comprising: one or more sources configured to dispense a first fluid flow stream and a second fluid flow stream, wherein at least the first fluid flow stream comprises a fiber; a mixing partition downstream from the one or more sources, the mixing partition positioned between the first and second flow streams, the mixing partition defining two or more openings in the mixing partition that permit fluid communication between the two flow streams; an enclosed region situated downstream from the one or more sources and surrounding at least a portion of the mixing partition, wherein the enclosed region is adapted to apply a pressure thereto; and a receiving region situated downstream from the one or more sources and designed to receive at least a combined flow stream and form a nonwoven web by collecting fiber from the combined flow stream.

In any such first embodiment, either alone or in combination with any other embodiment or combination of embodiments listed herein, the pressure is applied to urge the second flow stream through one or more openings in the mixing partition. In any such first embodiment, either alone or in combination with any other embodiment or combination of embodiments listed herein, pressure is applied to the enclosed region by the second flow stream flowing into the enclosed region. In any such first embodiment, either alone or in combination with any other embodiment or combination of embodiments listed herein, the second flow stream is dispensed under pressure. In any such first embodiment, either alone or in combination with any other embodiment or combination of embodiments listed herein, pressure is applied to the enclosed region by a source of hydraulic pressure. In any such first embodiment, either alone or in combination with any other embodiment or combination of embodiments listed herein, pressure is applied to the enclosed region by compression of one or more air spaces within the enclosed region. In any such first embodiment, either alone or in combination with any other embodiment or combination of embodiments listed herein, pressure is applied to the enclosed region by a source of pressure not connected to the one or more sources of first and second fluid flow streams. In any such first embodiment, either alone or in combination with any other embodiment or combination of embodiments listed herein, the apparatus further comprises one or more valves appended to the enclosed region and adapted to release pressure in excess of a selected value, or release undispensed second flow stream from the enclosed region, or both. In any such first embodiment, either alone or in combination with any other embodiment or combination of embodiments listed herein, at least a portion of the mixing partition, at least a portion of the enclosed region, or both are adapted to be removable from the apparatus. In any such first embodiment, either alone or in combination with any other embodiment or combination of embodiments listed herein, the apparatus further comprises a flow distribution chamber located between the source of the second flow stream and the enclosed region, and in fluid communication with both the source and the enclosed region; wherein the flow distribution chamber is adapted to distribute the second flow stream evenly across the mixing partition in the cross-web direction. In any such first embodiment, either alone or in combination with any other embodiment or combination of embodiments listed herein, the mixing partition is configured to provide a gradient in the nonwoven web.

2. Second Embodiment

A second embodiment of the invention, either alone or in combination with any other embodiment or combination of embodiments listed in this section or elsewhere herein, contemplates an apparatus for making a nonwoven web, the apparatus comprising a first source configured to dispense a first fluid flow stream comprising a first fiber; a second source configured to dispense a second fluid flow stream comprising a second fiber that is different from the first fiber; a mixing partition downstream from the first and second sources, the mixing partition positioned between the first and second flow streams, the mixing partition defining two or more openings in the mixing partition that permit fluid communication between the first and second flow streams; an enclosed region situated downstream from the first and second sources and surrounding at least a portion of the mixing partition, the enclosed region adapted to apply a pressure thereto; and a receiving region situated downstream from the first and second sources and designed to receive at least a combined flow stream and form a nonwoven web by collecting the combined flow stream.

In any such second embodiment, either alone or in combination with any other embodiment or combination of embodiments listed herein, pressure is applied to the second flow stream to urge the second flow stream through one or more openings in the mixing partition. In any such second embodiment, either alone or in combination with any other embodiment or combination of embodiments listed herein, pressure is applied to the enclosed region by the second flow stream flowing into the enclosed region. In any such second embodiment, either alone or in combination with any other embodiment or combination of embodiments listed herein, the second flow stream is dispensed under pressure. In any such second embodiment, either alone or in combination with any other embodiment or combination of embodiments listed herein, pressure is applied to the enclosed region by a source of hydraulic pressure. In any such second embodiment, either alone or in combination with any other embodiment or combination of embodiments listed herein, pressure is applied to the enclosed region by compression of one or more air spaces within the enclosed region. In any such second embodiment, either alone or in combination with any other embodiment or combination of embodiments listed herein, pressure is applied to the enclosed region by a source of pressure not connected to the one or more sources of first and second fluid flow streams. In any such second embodiment, either alone or in combination with any other embodiment or combination of embodiments listed herein, the apparatus further comprises one or more valves appended to the enclosed region and adapted to release pressure in excess of a selected value, or release undispensed second flow stream from the enclosed region, or both. In any such second embodiment, either alone or in combination with any other embodiment or combination of embodiments listed herein, at least a portion of the mixing partition, at least a portion of the enclosed region, or both are adapted to be removable from the apparatus. In any such second embodiment, either alone or in combination with any other embodiment or combination of embodiments listed herein, the apparatus further comprises a flow distribution chamber located between the source of the second flow stream and the enclosed region, and in fluid communication with both the source and the enclosed region; wherein the flow distribution chamber is adapted to distribute the second flow stream evenly across the mixing partition in the cross-web direction. In any such second embodiment, either alone or in combination with any other embodiment or combination of embodiments listed herein, the mixing partition is configured to provide a gradient in the nonwoven web.

3. Third Embodiment

A third embodiment of the invention, either alone or in combination with any other embodiment or combination of embodiments listed in this section or elsewhere herein, contemplates a method of making a nonwoven web, the method comprising providing a furnish from a source, the furnish comprising at least a first fiber; dispensing the furnish across a mixing partition downstream from the source, the mixing partition defining two or more openings configured to allow passage of at least a portion of the furnish, the mixing partition further comprising an enclosed region surrounding at least a portion of the mixing partition and adapted to apply a pressure therein; applying a pressure within the enclosed region; collecting fiber from the furnish passing through the two or more openings on a receiving region situated downstream from the source to form a wet layer on the receiving region; and drying the wet layer to form the nonwoven web.

In any such third embodiment, either alone or in combination with any other embodiment or combination of embodiments listed herein, the pressure applied to the enclosed region urges the furnish through one or more of the openings in the mixing partition. In any such third embodiment, either alone or in combination with any other embodiment or combination of embodiments listed herein, the nonwoven web is formed at a line speed of about 10 meter/min to 2000 meter/min. In any such third embodiment, either alone or in combination with any other embodiment or combination of embodiments listed herein, the nonwoven web is formed at a line speed of about 100 meter/min to 1000 meter/min. In any such third embodiment, either alone or in combination with any other embodiment or combination of embodiments listed herein, the nonwoven web is formed at a line speed of about 500 meter/min to 2000 meter/min. In any such third embodiment, either alone or in combination with any other embodiment or combination of embodiments listed herein, the furnish is a first furnish from a first source, and after passing through the mixing partition the first furnish is combined with a second furnish from a second source. In any such third embodiment, either alone or in combination with any other embodiment or combination of embodiments listed herein, the first source and the second source are pressurized sources. In any such third embodiment, either alone or in combination with any other embodiment or combination of embodiments listed herein, pressure is applied to the furnish by dispensing the furnish into the enclosed region. In any such third embodiment, either alone or in combination with any other embodiment or combination of embodiments listed herein, the source of furnish is a pressurized source. In any such third embodiment, either alone or in combination with any other embodiment or combination of embodiments listed herein, pressure is applied to the enclosed region by a source of hydraulic pressure. In any such third embodiment, either alone or in combination with any other embodiment or combination of embodiments listed herein, pressure is applied to the enclosed region by a compressed gas source. In any such third embodiment, either alone or in combination with any other embodiment or combination of embodiments listed herein, pressure is applied to the enclosed region by a pressure source not connected to the source of furnish. In any such third embodiment, either alone or in combination with any other embodiment or combination of embodiments listed herein, after the collecting the fiber and before drying of the wet layer, one or more additional materials are applied to the wet layer. In any such third embodiment, either alone or in combination with any other embodiment or combination of embodiments listed herein, the one or more additional materials comprise one or more resins, binders, fillers, particulates, flame retardants, chemically reactive compounds, coating materials, colorants, antioxidants, bactericidal compounds, fungicidal compounds, or a combination thereof. In any such third embodiment, either alone or in combination with any other embodiment or combination of embodiments listed herein, the additional materials are applied by spraying, dipping, curtain coating, die coating, roll coating, rotogravure coating, or plasma coating.

4. Fourth Embodiment

A fourth embodiment of the invention, either alone or in combination with any other embodiment or combination of embodiments listed in this section or elsewhere herein, contemplates an enclosed mixing partition assembly, the assembly comprising a mixing partition configured to provide a gradient in a nonwoven web; and an enclosure surrounding the mixing partition or a section thereof such that the mixing partition defines two or more openings, the enclosure adapted to provide an applied pressure therein, wherein the assembly further comprises at least one inlet for dispensing a fluid therein.

In any such fourth embodiment, either alone or in combination with any other embodiment or combination of embodiments listed herein, the pressure is applied to a fluid within the enclosure. In any such fourth embodiment, either alone or in combination with any other embodiment or combination of embodiments listed herein, the enclosure is a cuboid shape. In any such fourth embodiment, either alone or in combination with any other embodiment or combination of embodiments listed herein, the enclosure comprises a movable wall distal to the at least one inlet, wherein the movable wall is movable along a plane defined by the mixing partition. In any such fourth embodiment, either alone or in combination with any other embodiment or combination of embodiments listed herein, the assembly of claim 38 further comprising one or more sources of pressure attached to the enclosure and adapted to apply pressure within the enclosure. In any such fourth embodiment, either alone or in combination with any other embodiment or combination of embodiments listed herein, the source of pressure is compressed air or a hydraulic pump. In any such fourth embodiment, either alone or in combination with any other embodiment or combination of embodiments listed herein, the assembly further comprises one or more valves or pressure gauges attached thereto. In any such fourth embodiment, either alone or in combination with any other embodiment or combination of embodiments listed herein, the mixing partition further comprises one or more weirs extending into the enclosure and adapted to modify the flow of fluid near the one or more openings in the mixing partition. In any such fourth embodiment, either alone or in combination with any other embodiment or combination of embodiments listed herein, the assembly further comprises a flow distribution chamber. In any such fourth embodiment, either alone or in combination with any other embodiment or combination of embodiments listed herein, the two or more openings in the mixing partition are configured to provide a gradient through the thickness of a nonwoven web, such that the gradient is substantially uniform in the cross web direction. In any such fourth embodiment, either alone or in combination with any other embodiment or combination of embodiments listed herein, the two or more openings are rectangular slots extending across substantially the entirety of the width of the mixing partition, the width of the mixing partition corresponding to the cross web dimension of the web and the length of the slots. In any such fourth embodiment, either alone or in combination with any other embodiment or combination of embodiments listed herein, the width of the slots is about 0.05 cm to 25 cm. In any such fourth embodiment, either alone or in combination with any other embodiment or combination of embodiments listed herein, the distance between any two slots is about 2 cm to 100 cm.

EXPERIMENTAL SECTION

1. General Procedure for Preparation of Furnishes

Furnishes were formulated to produce nonwoven webs having at least one gradient property. Table 1 shows compositional information about the furnish formulations. The following different fibers were used in the furnish examples listed in Table 1, where an abbreviation for each fiber is provided in parenthesis:

1. A polyester bicomponent fiber (271P) having a fiber length of 6 mm and 2.2 denier and average fiber diameter of about 13 microns, available from E. I. DuPont Nemours, Wilmington Del.
2. Polyester fiber (P145) having diameter of 1.45 denier and length of 6 mm, available from Barnet USA of Arcadia, S.C.
3. Glass fibers (B10F) from Lauscha Fiber Intl., of Summerville, S.C. having a variable length and fiber diameter of 1 micron.

4. Glass fibers (B06F) from Lauscha Fiber Intl. having a variable length and fiber diameter of 0.6 micron.

Stock furnishes were prepared as follows. Fibers were dispersed in an aqueous suspension by first adding sulfuric acid to tap water to adjust the pH to approximately 3.0, followed by addition of the selected fibers in the dry weight percentages listed for various Examples to form a fiber suspension or slurry. The final fiber content of the stock furnishes was approximately 0.23 wt %. The stock furnishes were stored in storage tanks for subsequent use. During media manufacturing, the stock furnishes were diluted and fed in continuous fashion to their respective headboxes, which in turn dispensed the furnishes to the media forming apparatus. The final concentration of fiber in the furnishes dispensed to the media forming apparatus is variable and is reported for each Example.

2. Media Forming Apparatus and Method of Using

The apparatus employed in making the gradient webs was an inclined Fourdrinier type papermaking machine, the general nature of which is described above. The machine was fitted with an enclosed mixing partition, such that the enclosed mixing partition interior dimensions had an overall length (machine direction) of 70.5 inches (179.1 cm); width (cross web direction) of about 23.5 inches (59.7 cm); and height of about 5.75 inches (14.6 cm). The mixing partition was surrounded by a cuboid enclosure constructed in the laboratory from polycarbonate sheeting, with aluminum sheeting employed to form the proximal and distal vertical walls. The vertical enclosure wall near distal end 324 in FIG. 14 was configured to be both removable and slidably movable. The movable/removable wall was configured to allow the effective volume of the enclosure to be selectively varied and also to provide an open configuration wherein pressure would not be build up within the enclosure. Thus the overall volume defined by the enclosure and mixing partition, where the movable/removable wall was attached to the enclosure at the furthest distal point, was 5.51 $ft^3$, or 41.2 gallons, or 156 liters. The enclosure was also fitted with a flow distribution chamber, to which a headbox was connected to deliver furnish. The flow distribution chamber was constructed in the laboratory from PMMA sheeting. The general design, disposition, and adaptation of the flow distribution chamber and the enclosed mixing partition were configured generally as shown in FIGS. 14 and 15. The flow distribution chamber was adapted with 6 circular inlets 362 having an inner diameter of about 0.875 inches (2.22 cm) for the introduction of furnish to the flow distribution chamber, and 9 circular openings 363 having an inner diameter of about 2.0 inches (5.1 cm) to deliver furnish to the enclosed mixing partition 310, 360.

The mixing partition was constructed from a series of rectangular stainless steel sheet portions about 0.25 inches (0.64 cm) thick, about 23.5 inches (59.7 cm) long, and of variable widths selected for individual experimentation. The pieces, or slats, were positioned to define slots, that is, mixing partition openings, of variable width between the slats.

Referring to FIG. 14, Furnish 1 was delivered to the enclosure 160 as pressurized fluid flow stream delivered via the flow distribution chamber 361 through openings 363 and across proximal end 322 of enclosed mixing partition 310, 360. Furnish 2 was delivered as fluid flow stream 104, as represented in FIG. 3. Both furnishes were delivered by headbox apparatuses. Furnish 1 was delivered to the flow distribution chamber by Headbox 1 while Furnish 2 was delivered by Headbox 2. Both headboxes were set to deliver furnish at flow rates of 350 l/min.

As discussed above and further in reference to FIG. 3, the receiving region 114 includes drainage boxes 130 to receive the water draining from the wire guide 118. These drainage boxes, which are also referred to flat boxes, may be configured to apply a vacuum. In the apparatus used to generate the examples, there were six drainage boxes 130, each capable of controlling the drainage over about 25.4 cm. (10 inches) of the horizontal distance underneath the wire guide. Valves underneath the drainage boxes controlled the rate of drainage. Vacuum was not used in conjunction with the six drainage boxes. Drainage flow, as facilitated by gravity only, was measured for each of the six drainage boxes during media formation. Downstream from the six drainage boxes, four vacuum drainage boxes were employed to remove additional water from the wet layer. Vacuum was applied across the vacuum drainage boxes using a Nash HYTOR™ vacuum pump, available from Gardner Denver Inc. of Wayne, Pa.

It will be understood by one of skill that the experimental data were generated by employing the below-specified machine settings for variables such as drainage box flow rates, but that the actual drainage rates incurred by such settings vary during the experiments. Thus, the machine settings noted as "Set Values" in e.g. Table 2 are the settings actually employed to provide the test results observed.

3. Analytical Tests

The gradient media formed in the Examples were analyzed using the following testing apparatus and procedures.

1. Basis weight: weight per unit of area, expressed as pounds per 3000 $ft^2$ or $g/m^2$.
2. Permeability: as measured on an FX 3310 Air Permeability Tester from ATI Advanced Testing Instruments of Greer, S.C. at 0.5 inch $H_2O$ pressure drop and expressed as $ft^3$/min or l/min.
3. Penetration: as measured on a Penetrometer TDA-100P from ATI Air Techniques Intl. of Owings Mills, Md., using 0.2-0.3 micron poly(a-olefin) particles at 10.5 fpm and expressed as a percentage; additionally or alternatively, efficiency is (100%-penetration).
4. Resistance: as measured on a Penetrometer TDA-100P from ATI Air Techniques Intl. of Owings Mills, Md., using 0.2-0.3 micron poly(a-olefin) particles at 10.5 fpm and expressed as inches of $H_2O$.

Example 1

Stock furnishes were prepared according to the General Procedure for Preparation of Furnishes, using the dry weight percent of fibers indicated in Table 1.

TABLE 1

| Component | Fiber type | Dry Wt % |
|---|---|---|
| | Furnish 1 | |
| A | 271P | 62 |
| B | P145 | 25 |
| C | B06F | 13 |
| | Furnish 2 | |
| A | 271P | 51.28 |
| B | B10F | 48.72 |

The final concentration of fiber in Furnish 1 was 0.039 wt %. The final concentration of fiber in Furnish 2 was 0.036 wt %. A gradient media was produced using the furnishes shown in Table 1, in conjunction with the Media Forming Apparatus and Method of Using. Run parameters of the media forming apparatus are shown in Table 2. Where applicable, various zone or number designations in Table 2 proceed from upstream to downstream (machine direction) on the machine.

TABLE 2

| | Variable | Set Value |
|---|---|---|
| Flat/Drainage Box 1 Flow | l/min | 75 |
| Flat/Drainage Box 2 Flow | l/min | 100 |
| Flat/Drainage Box 3 Flow | l/min | 125 |
| Flat/Drainage Box 4 Flow | l/min | 125 |
| Flat/Drainage Box 5 Flow | l/min | 175 |
| Flat/Drainage Box 6 Flow | l/min | 25 |
| Dryer Temperature, Zone 1 | ° F. (° C.) | 220 (104) |
| Dryer Temperature, Zone 2 | ° F. (° C.) | 240 (116) |
| Dryer Temperature, Zone 3 | ° F. (° C.) | 260 (127) |
| Incline Wire Angle | Degrees | 15 |
| Machine speed | fpm (m/min.) | 15 (4.6) |

The removable vertical wall of the mixing partition enclosure was in place as the machine was run, that is, the mixing partition was enclosed and thus capable of having a pressure applied thereto. The movable/removable vertical wall of the mixing partition enclosure was in place as the machine was run, that is, the mixing partition was enclosed and thus capable of having a pressure applied thereto. The movable/removable distal wall was set to be 34.65 inches (88.02 cm) from the proximal vertical wall. The mixing partition slats (rectangular pieces described above) and slots (spaces between the slats) were arranged as shown in Table 3, wherein the numbered order proceeds from upstream, or nearest to proximal end 322 of FIG. 14, to downstream, or toward distal end 324. The first feature is (potentially) a slot, defined by the vertical wall on proximal end 322 and the position of the first slat.

TABLE 3

| Mixing Partition Feature | Down web distance, inches (cm) |
|---|---|
| Slot 1 | 0 (0) |
| Slat 1 | 8 (20.32) |
| Slot 2 | 0.125 (0.32) |
| Slat 2 | 8 (20.32) |
| Slot 3 | 0.125 (0.32) |
| Slat 3 | 15 (38.10) |
| Slot 4 | 0.4 (1.02) |
| Slat 4 | 3 (7.62) |
| Slot 5 | 0 (0) |
| Slat 5 | 0 (0) |
| TOTAL (slots + slats) | 34.65 (88.02) |

During the run, the enclosed mixing partition was observed to be partially full; thus, an air space was present in the enclosure during the runs, but all slots were covered with Furnish 1. The gradient media formed had a basis weight of 69.6 lb/3000 $ft^2$ (113.3 $g/m^2$), permeability of 28.3 $ft^3$/min. (801 l/min), penetration of 19.11% (ATI efficiency of 80.89%), and resistance of 0.213 inch $H_2O$.

Example 2

Gradient media was produced using the furnishes of Example 1, except that the final concentration of fiber in Furnish 1 was 0.045 wt % and the final concentration of fiber in Furnish 2 was 0.045 wt %. The gradient media was produced using the procedure of Example 1 except the movable/removable vertical wall of the mixing partition enclosure was removed so that the mixing partition was open at the distal end and thus any excess furnish would simply exit the distal end of the mixing partition instead of being retained inside an enclosure where pressure could be built up as a result. The mixing partition slats (rectangular pieces described above) and slots (spaces between the slats) were arranged as shown in Table 4, wherein the numbered order proceeds from upstream, or nearest to proximal end 322 of FIG. 14, to downstream, or toward distal end 324. The first feature is (potentially) a slot, defined by the vertical wall on proximal end 322 and the first slat.

TABLE 4

| Mixing Partition Feature | Down web distance, inches (cm) |
|---|---|
| Slot 1 | 0 (0) |
| Slat 1 | 8 (20.32) |
| Slot 2 | 0.125 (0.32) |
| Slat 2 | 8 (20.32) |
| Slot 3 | 0.125 (0.32) |
| Slat 3 | 6 (15.24) |
| Slot 4 | 0.125 (0.32) |
| Slat 4 | 9 (22.86) |
| Slot 5 | 0.35 (0.89) |
| Slat 5 | 3 (7.62) |

During the run, the mixing partition did not fill with Furnish 1 sufficiently to cause excess furnish to spill over the downstream end of the mixing partition where the vertical wall was removed. The gradient media formed had a basis weight of 62.1 lb/3000 $ft^2$ (101.1 $g/m^2$), permeability of 26.6 $ft^3$/min. (753.2 l/min), penetration of 17.42% (ATI efficiency of 82.58%), and resistance of 0.227 inch $H_2O$.

Example 3

Stock furnishes were prepared according to the General Procedure for Preparation of Furnishes, using the dry weight percent of fibers indicated in Table 5.

TABLE 5

| Component | Fiber type | Dry Wt % |
|---|---|---|
| | Furnish 1 | |
| A | 271P | 62 |
| B | P145 | 25 |
| C | B06F | 13 |
| | Furnish 2 | |
| A | 271P | 46-48 |
| B | B10F | 52-54 |

The final concentration of fiber in Furnish 1 was 0.042 wt %. The final concentration of fiber in Furnish 2 was 0.035 wt %. The furnishes were used to form media using the procedure outlined in the section above entitled Media Forming Apparatus and Method of Using. Run parameters of the media forming apparatus are shown in Table 6. Where applicable, various zone or number designations in Table 6 proceed from upstream to downstream (machine direction) on the machine.

TABLE 6

| | Variable | Set Value |
|---|---|---|
| Flat/Drainage Box 1 Flow | l/min | 75 |
| Flat/Drainage Box 2 Flow | l/min | 100 |
| Flat/Drainage Box 3 Flow | l/min | 125 |
| Flat/Drainage Box 4 Flow | l/min | 125 |

TABLE 6-continued

| | Variable | Set Value |
|---|---|---|
| Flat/Drainage Box 5 Flow | l/min | 175 |
| Flat/Drainage Box 6 Flow | l/min | 75 |
| Dryer Temperature, Zone 1 | ° F. (° C.) | 220 (104) |
| Dryer Temperature, Zone 2 | ° F. (° C.) | 240 (116) |
| Dryer Temperature, Zone 3 | ° F. (° C.) | 260 (127) |
| Incline Wire Angle | Degrees | 15 |
| Machine speed | fpm (m/min.) | 15 (4.6) |

The movable/removable vertical wall of the mixing partition enclosure was in place as the machine was run, that is, the mixing partition was enclosed and thus capable of having a pressure applied thereto. The movable/removable distal wall was set to be 34.65 inches (88.01 cm) from the proximal vertical wall. The mixing partition slats (rectangular pieces described above) and slots (spaces between the slats) were arranged as shown in Table 7, wherein the numbered order proceeds from upstream, or nearest to proximal end 322 of FIG. 14, to downstream, or toward distal end 324. The first feature is (potentially) a slot, defined by the vertical wall on proximal end 322 and the position of the first slat.

TABLE 7

| Mixing Partition Feature | Down web distance, inches (cm) |
|---|---|
| Slot 1 | 0 (0) |
| Slat 1 | 8 (20.32) |
| Slot 2 | 0.125 (0.32) |
| Slat 2 | 8 (20.32) |
| Slot 3 | 0.125 (0.32) |
| Slat 3 | 15 (38.1) |
| Slot 4 | 0.4 (1.0) |
| Slat 4 | 3 (7.6) |

During the run, the enclosed mixing partition was observed to be partially full; thus, an air space was present in the enclosure during the runs, but all slots were covered with Furnish 1. The gradient media formed had a basis weight of 57.8 lb/3000 $ft^2$ (94.1 $g/m^2$), permeability of 27.23 $ft^3$/min. (771.1 l/min), penetration of 13.99% (efficiency of 86.02%), and resistance of 0.241 inch $H_2O$.

Example 4

Gradient media was produced using the furnishes of Example 3. The final concentration of fiber in Furnish 1 was 0.042 wt %. The final concentration of fiber in Furnish 2 was 0.035 wt %. The furnishes were used to form media using the procedure outlined in the section above entitled Media Forming Apparatus and Method of Using. Run parameters of the media forming apparatus are shown in Table 8. Where applicable, various zone or number designations in Table 8 proceed from upstream to downstream (machine direction) on the machine.

TABLE 8

| | Variable | Set Value |
|---|---|---|
| Flat/Drainage Box 1 Flow | l/min | 75 |
| Flat/Drainage Box 2 Flow | l/min | 100 |
| Flat/Drainage Box 3 Flow | l/min | 125 |
| Flat/Drainage Box 4 Flow | l/min | 125 |
| Flat/Drainage Box 5 Flow | l/min | 160 |
| Flat/Drainage Box 6 Flow | l/min | 75 |
| Dryer Temperature, Zone 1 | ° F. (° C.) | 220 (104) |

TABLE 8-continued

| | Variable | Set Value |
|---|---|---|
| Dryer Temperature, Zone 2 | ° F. (° C.) | 240 (116) |
| Dryer Temperature, Zone 3 | ° F. (° C.) | 260 (127) |
| Incline Wire Angle | Degrees | 15 |
| Machine speed | fpm (m/min.) | 15 (4.6) |

The movable/removable vertical wall of the mixing partition enclosure was in place as the machine was run, that is, the mixing partition was enclosed and thus capable of having a pressure applied thereto. The movable/removable distal wall was set to be 34.00 inches (86.36 cm) from the proximal vertical wall. The mixing partition slats (rectangular pieces described above) and slots (spaces between the slats) were arranged as shown in Table 9, wherein the numbered order proceeds from upstream, or nearest to proximal end 322 of FIG. 14, to downstream, or toward distal end 324. The first feature is (potentially) a slot, defined by the vertical wall on proximal end 322 and the position of the first slat.

TABLE 9

| Mixing Partition Feature | Down web distance, inches (cm) |
|---|---|
| Slot 1 | 0 (0) |
| Slat 1 | 8 (20.32) |
| Slot 2 | 0.125 (0.32) |
| Slat 2 | 8 (20.32) |
| Slot 3 | 0.125 (0.32) |
| Slat 3 | 12 (30.48) |
| Slot 4 | 0.75 (1.91) |
| Slat 4 | 5 (12.70) |

During the run, the enclosed mixing partition was observed to be partially full; thus, an air space was present in the enclosure during the runs, but all slots were covered with Furnish 1. The gradient media formed had a basis weight of 55.0 lb/3000 $ft^2$ (89.5 $g/m^2$), permeability of 26.3 $ft^3$/min. (744.7 l/min), penetration of 13.05% (efficiency of 86.95%), and resistance of 0.246 inch $H_2O$.

Example 5

Gradient media was produced using the furnishes of Example 3. The final concentration of fiber in Furnish 1 was 0.042 wt %. The final concentration of fiber in Furnish 2 was 0.035 wt %. The furnishes were used to form media using the procedure outlined in the section above entitled Media Forming Apparatus and Method of Using. Run parameters of the media forming apparatus are the same as used in Example 4 (Table 8).

The movable/removable vertical wall of the mixing partition enclosure was in place as the machine was run, that is, the mixing partition was enclosed and thus capable of having a pressure applied thereto. The movable/removable distal wall was set to be 34.13 inches (86.69 cm) from the proximal vertical wall. The mixing partition slats (rectangular pieces described above) and slots (spaces between the slats) were arranged as shown in Table 10, wherein the numbered order proceeds from upstream, or nearest to proximal end 322 of FIG. 14, to downstream, or toward distal end 324. The first feature is (potentially) a slot, defined by the vertical wall on proximal end 322 and the position of the first slat.

TABLE 10

| Mixing Partition Feature | Down web distance, inches (cm) |
|---|---|
| Slot 1 | 0.125 (0.32) |
| Slat 1 | 8 (20.32) |
| Slot 2 | 0.125 (0.32) |
| Slat 2 | 8 (20.32) |
| Slot 3 | 0.125 (0.32) |
| Slat 3 | 12 (30.48) |
| Slot 4 | 0.75 (1.91) |
| Slat 4 | 5 (12.70) |

During the run, the enclosed mixing partition was observed to be partially full; thus, an air space was present in the enclosure during the runs, but all slots were covered with Furnish 1. The gradient media formed had a basis weight of 57.2 lb/3000 $ft^2$ (93.1 $g/m^2$), permeability of 30.12 $ft^3$/min. (852.9 l/min), penetration of 18.12% (efficiency of 81.88%), and resistance of 0.204 inch $H_2O$.

Example 6

A gradient media was formed using the same furnishes, procedures, machine set values, an mixing partition configuration as in Example 5 except that the final furnish fiber concentrations were 0.039 wt % for Furnish 1 and 0.035 wt % for Furnish 2.

During the run, the enclosed mixing partition was observed to be partially full; thus, an air space was present in the enclosure during the runs, but all slots were covered with Furnish 1. The gradient media formed had a basis weight of 56.0 lb/3000 $ft^2$ (91.1 $g/m^2$), permeability of 27.6 $ft^3$/min. (781.5 l/min), penetration of 15.27% (efficiency of 84.73%), and resistance of 0.225 inch $H_2O$.

Example 7

Stock furnishes were prepared according to the General Procedure for Preparation of Furnishes, using the dry weight percent of fibers indicated in Table 11.

TABLE 11

| Component | Fiber type | Dry Wt % |
|---|---|---|
| | Furnish 1 | |
| A | 271P | 62.5 |
| B | P145 | 25 |
| C | B06F | 12.5 |
| | Furnish 2 | |
| A | 271P | 57.5 |
| B | B10F | 42.5 |

The final concentration of fiber in Furnish 1 was 0.036 wt %. The final concentration of fiber in Furnish 2 was 0.041 wt %. The furnishes were used to form media using the procedure outlined in the section above entitled Media Forming Apparatus and Method of Using. Run parameters of the media forming apparatus are shown in Table 12. Where applicable, various zone or number designations in Table 12 proceed from upstream to downstream (machine direction) on the machine.

TABLE 12

| | Variable | Set Value |
|---|---|---|
| Flat/Drainage Box 1 Flow | l/min | 50 |
| Flat/Drainage Box 2 Flow | l/min | 50 |
| Flat/Drainage Box 3 Flow | l/min | 50 |
| Flat/Drainage Box 4 Flow | l/min | 100 |
| Flat/Drainage Box 5 Flow | l/min | 100 |
| Flat/Drainage Box 6 Flow | l/min | 100 |
| Dryer Temperature, Zone 1 | ° F. (° C.) | 250 (121) |
| Dryer Temperature, Zone 2 | ° F. (° C.) | 235 (113) |
| Dryer Temperature, Zone 3 | ° F. (° C.) | 220 (104) |
| Incline Wire Angle | Degrees | 15 |
| Machine speed | fpm (m/min.) | 15 (4.6) |

The movable/removable vertical wall of the mixing partition enclosure was in place as the machine was run, that is, the mixing partition was enclosed and thus capable of having a pressure applied thereto. The movable/removable distal wall was set to be 24.38 inches (61.93 cm) from the proximal vertical wall. The mixing partition slats (rectangular pieces described above) and slots (spaces between the slats) were arranged as shown in Table 13, wherein the numbered order proceeds from upstream, or nearest to proximal end 322 of FIG. 14, to downstream, or toward distal end 324. The first feature is (potentially) a slot, defined by the vertical wall on proximal end 322 and the position of the first slat.

TABLE 13

| Mixing Partition Feature | Down web distance, inches (cm) |
|---|---|
| Slot 1 | 0 (0) |
| Slat 1 | 6 (15.24) |
| Slot 2 | 0.125 (0.32) |
| Slat 2 | 6 (15.24) |
| Slot 3 | 0.125 (0.32) |
| Slat 3 | 6 (15.24) |
| Slot 4 | 0.125 (0.32) |
| Slat 4 | 6 (15.24) |

During the run, the enclosed mixing partition was observed to be completely full; no air space was observed in the enclosure during the run. The gradient media formed had a basis weight of 56.0 lb/3000 $ft^2$ (91.1 $g/m^2$), permeability of 28.15 $ft^3$/min. (797.1 l/min), penetration of 16.0% (efficiency of 84.0%), and resistance of 0.221 inch $H_2O$.

Example 8

Gradient media was produced using the furnishes of Example 7 (Table 11). The final concentration of fiber in Furnish 1 was 0.034 wt %. The final concentration of fiber in Furnish 2 was 0.044 wt %. The furnishes were used to form media using the procedure outlined in the section above entitled Media Forming Apparatus and Method of Using. Run parameters of the media forming apparatus are shown in Table 14. Where applicable, various zone or number designations in Table 14 proceed from upstream to downstream (machine direction) on the machine.

TABLE 14

| | Variable | Set Value |
|---|---|---|
| Flat/Drainage Box 1 Flow | l/min | 75 |
| Flat/Drainage Box 2 Flow | l/min | 75 |
| Flat/Drainage Box 3 Flow | l/min | 75 |
| Flat/Drainage Box 4 Flow | l/min | 100 |
| Flat/Drainage Box 5 Flow | l/min | 100 |

TABLE 14-continued

| | Variable | Set Value |
|---|---|---|
| Flat/Drainage Box 6 Flow | l/min | 100 |
| Dryer Temperature, Zone 1 | ° F. (° C.) | 250 (121) |
| Dryer Temperature, Zone 2 | ° F. (° C.) | 235 (113) |
| Dryer Temperature, Zone 3 | ° F. (° C.) | 220 (104) |
| Incline Wire Angle | Degrees | 15 |
| Machine speed | fpm (m/min.) | 15 (4.6) |

The movable/removable vertical wall of the mixing partition enclosure was in place as the machine was run, that is, the mixing partition was enclosed and thus capable of having a pressure applied thereto. The movable/removable distal wall was set to be 24.38 inches (61.93 cm) from the proximal vertical wall. The mixing partition slats (rectangular pieces described above) and slots (spaces between the slats) were arranged as in Example 7 (Table 13).

During the run, the enclosed mixing partition was observed to be partially full; thus, an air space was present in the enclosure during the runs, but all slots were covered with Furnish 1. The gradient media formed had a basis weight of 59.25 lb/3000 $ft^2$ (96.43 $g/m^2$), permeability of 25.95 $ft^3$/min. (734.8 l/min), penetration of 13.1% (efficiency of 86.9%), and resistance of 0.248 inch $H_2O$.

Example 9

Gradient media was produced using the furnishes of Example 7 (Table 11). The final concentration of fiber in Furnish 1 was 0.036 wt %. The final concentration of fiber in Furnish 2 was 0.041 wt %. The furnishes were used to form media using the procedure outlined in the section above entitled Media Forming Apparatus and Method of Using. Run parameters of the media forming apparatus are shown in Table 15. Where applicable, various zone or number designations in Table 15 proceed from upstream to downstream (machine direction) on the machine.

TABLE 15

| | Variable | Set Value |
|---|---|---|
| Flat/Drainage Box 1 Flow | l/min | 150 |
| Flat/Drainage Box 2 Flow | l/min | 150 |
| Flat/Drainage Box 3 Flow | l/min | 150 |
| Flat/Drainage Box 4 Flow | l/min | 120 |
| Flat/Drainage Box 5 Flow | l/min | 100 |
| Flat/Drainage Box 6 Flow | l/min | 75 |
| Dryer Temperature, Zone 1 | ° F. (° C.) | 250 (121) |
| Dryer Temperature, Zone 2 | ° F. (° C.) | 240 (116) |
| Dryer Temperature, Zone 3 | ° F. (° C.) | 230 (110) |
| Incline Wire Angle | Degrees | 15 |
| Machine speed | fpm (m/min.) | 15 (4.6) |

The movable/removable vertical wall of the mixing partition enclosure was in place as the machine was run, that is, the mixing partition was enclosed and thus capable of having a pressure applied thereto. The movable/removable distal wall was set to be 21.25 inches (53.98 cm) from the proximal vertical wall. The mixing partition slats (rectangular pieces described above) and slots (spaces between the slats) were arranged as shown in Table 16, wherein the numbered order proceeds from upstream, or nearest to proximal end 322 of FIG. 14, to downstream, or toward distal end 324. The first feature is (potentially) a slot, defined by the vertical wall on proximal end 322 and the position of the first slat.

TABLE 16

| Mixing Partition Feature | Down web distance, inches (cm) |
|---|---|
| Slot 1 | 0.5 (1.27) |
| Slat 1 | 6 (15.24) |
| Slot 2 | 0.5 (1.27) |
| Slat 2 | 6 (15.24) |
| Slot 3 | 0.25 (0.64) |
| Slat 3 | 8 (20.32) |

During the run, the enclosed mixing partition was observed to be partially full; thus, an air space was present in the enclosure during the runs, but all slots were covered with Furnish 1. The gradient media formed had a basis weight of 63.7 lb/3000 $ft^2$ (103.7 $g/m^2$), permeability of 23.7 $ft^3$/min. (671.1 l/min), penetration of 11.0% (efficiency of 89.0%), and resistance of 0.258 inch $H_2O$.

Example 10

Gradient media was produced using the furnishes of Example 7 (Table 11). The final concentration of fiber in Furnish 1 was 0.034 wt %. The final concentration of fiber in Furnish 2 was 0.044 wt %. The furnishes were used to form media using the procedure outlined in the section above entitled Media Forming Apparatus and Method of Using. Run parameters of the media forming apparatus were the same as those used in Example 9 (Table 15).

The movable/removable vertical wall of the mixing partition enclosure was in place as the machine was run, that is, the mixing partition was enclosed and thus capable of having a pressure applied thereto. The movable/removable distal wall was set to be 21.25 inches (53.98 cm) from the proximal vertical wall. The mixing partition was configured as it was for Example 9 (Table 16).

During the run, the enclosed mixing partition was observed to be partially full; thus, an air space was present in the enclosure during the runs, but all slots were covered with Furnish 1. The gradient media formed had a basis weight of 56.65 lb/3000 $ft^2$ (92.20 $g/m^2$), permeability of 31.95 $ft^3$/min. (904.7 l/min), penetration of 20.0% (efficiency of 80.0%), and resistance of 0.187 inch $H_2O$.

Embodiments

5. First Embodiment

A first embodiment of the invention, either alone or in combination with any other embodiments or combination of embodiments listed in this section, contemplates an apparatus for making a nonwoven web, the apparatus comprising: one or more sources configured to dispense a first fluid flow stream and a second fluid flow stream, wherein at least the first fluid flow stream comprises a fiber; a mixing partition downstream from the one or more sources, the mixing partition positioned between the first and second flow streams, the mixing partition defining two or more openings in the mixing partition that permit fluid communication between the two flow streams; an enclosed region situated downstream from the one or more sources and surrounding at least a portion of the mixing partition, wherein the enclosed region is adapted to apply a pressure thereto; and a receiving region situated downstream from the one or more sources and designed to receive at least a combined flow stream and form a nonwoven web by collecting fiber from the combined flow stream.

In any such first embodiment, either alone or in combination with any other embodiment or combination of embodiments listed herein, the pressure is applied to urge the second flow stream through one or more openings in the mixing partition. In any such first embodiment, either alone or in combination with any other embodiment or combination of embodiments listed herein, pressure is applied to the enclosed region by the second flow stream flowing into the enclosed region. In any such first embodiment, either alone or in combination with any other embodiment or combination of embodiments listed herein, the second flow stream is dispensed under pressure. In any such first embodiment, either alone or in combination with any other embodiment or combination of embodiments listed herein, pressure is applied to the enclosed region by a source of hydraulic pressure. In any such first embodiment, either alone or in combination with any other embodiment or combination of embodiments listed herein, pressure is applied to the enclosed region by compression of one or more air spaces within the enclosed region. In any such first embodiment, either alone or in combination with any other embodiment or combination of embodiments listed herein, pressure is applied to the enclosed region by a source of pressure not connected to the one or more sources of first and second fluid flow streams. In any such first embodiment, either alone or in combination with any other embodiment or combination of embodiments listed herein, the apparatus further comprises one or more valves appended to the enclosed region and adapted to release pressure in excess of a selected value, or release undispensed second flow stream from the enclosed region, or both. In any such first embodiment, either alone or in combination with any other embodiment or combination of embodiments listed herein, at least a portion of the mixing partition, at least a portion of the enclosed region, or both are adapted to be removable from the apparatus. In any such first embodiment, either alone or in combination with any other embodiment or combination of embodiments listed herein, the apparatus further comprises a flow distribution chamber located between the source of the second flow stream and the enclosed region, and in fluid communication with both the source and the enclosed region; wherein the flow distribution chamber is adapted to distribute the second flow stream evenly across the mixing partition in the cross-web direction. In any such first embodiment, either alone or in combination with any other embodiment or combination of embodiments listed herein, the mixing partition is configured to provide a gradient in the nonwoven web.

6. Second Embodiment

A second embodiment of the invention, either alone or in combination with any other embodiments or combination of embodiments listed in this section, contemplates an apparatus for making a nonwoven web, the apparatus comprising a first source configured to dispense a first fluid flow stream comprising a first fiber; a second source configured to dispense a second fluid flow stream comprising a second fiber that is different from the first fiber; a mixing partition downstream from the first and second sources, the mixing partition positioned between the first and second flow streams, the mixing partition defining two or more openings in the mixing partition that permit fluid communication between the first and second flow streams; an enclosed region situated downstream from the first and second sources and surrounding at least a portion of the mixing partition, the enclosed region adapted to apply a pressure thereto; and a receiving region situated downstream from the first and second sources and designed to receive at least a combined flow stream and form a nonwoven web by collecting the combined flow stream.

In any such second embodiment, either alone or in combination with any other embodiment or combination of embodiments listed herein, pressure is applied to the second flow stream to urge the second flow stream through one or more openings in the mixing partition. In any such second embodiment, either alone or in combination with any other embodiment or combination of embodiments listed herein, pressure is applied to the enclosed region by the second flow stream flowing into the enclosed region. In any such second embodiment, either alone or in combination with any other embodiment or combination of embodiments listed herein, the second flow stream is dispensed under pressure. In any such second embodiment, either alone or in combination with any other embodiment or combination of embodiments listed herein, pressure is applied to the enclosed region by a source of hydraulic pressure. In any such second embodiment, either alone or in combination with any other embodiment or combination of embodiments listed herein, pressure is applied to the enclosed region by compression of one or more air spaces within the enclosed region. In any such second embodiment, either alone or in combination with any other embodiment or combination of embodiments listed herein, pressure is applied to the enclosed region by a source of pressure not connected to the one or more sources of first and second fluid flow streams. In any such second embodiment, either alone or in combination with any other embodiment or combination of embodiments listed herein, the apparatus further comprises one or more valves appended to the enclosed region and adapted to release pressure in excess of a selected value, or release undispensed second flow stream from the enclosed region, or both. In any such second embodiment, either alone or in combination with any other embodiment or combination of embodiments listed herein, at least a portion of the mixing partition, at least a portion of the enclosed region, or both are adapted to be removable from the apparatus. In any such second embodiment, either alone or in combination with any other embodiment or combination of embodiments listed herein, the apparatus further comprises a flow distribution chamber located between the source of the second flow stream and the enclosed region, and in fluid communication with both the source and the enclosed region; wherein the flow distribution chamber is adapted to distribute the second flow stream evenly across the mixing partition in the cross-web direction. In any such second embodiment, either alone or in combination with any other embodiment or combination of embodiments listed herein, the mixing partition is configured to provide a gradient in the nonwoven web.

7. Third Embodiment

A third embodiment of the invention, either alone or in combination with any other embodiments or combination of embodiments listed in this section, contemplates a method of making a nonwoven web, the method comprising providing a furnish from a source, the furnish comprising at least a first fiber; dispensing the furnish across a mixing partition downstream from the source, the mixing partition defining two or more openings configured to allow passage of at least a portion of the furnish, the mixing partition further comprising an enclosed region surrounding at least a portion of the mixing partition and adapted to apply a pressure therein; applying a pressure within the enclosed region; collecting fiber from the furnish passing through the two or more openings on a receiving region situated downstream from the source to form a wet layer on the receiving region; and drying the wet layer to form the nonwoven web.

In any such third embodiment, either alone or in combination with any other embodiment or combination of embodiments listed herein, the pressure applied to the enclosed region urges the furnish through one or more of the openings in the mixing partition. In any such third embodiment, either alone or in combination with any other embodiment or combination of embodiments listed herein, the nonwoven web is formed at a line speed of about 10 meter/min to 2000 meter/min. In any such third embodiment, either alone or in combination with any other embodiment or combination of embodiments listed herein, the nonwoven web is formed at a line speed of about 100 meter/min to 1000 meter/min. In any such third embodiment, either alone or in combination with any other embodiment or combination of embodiments listed herein, the nonwoven web is formed at a line speed of about 500 meter/min to 2000 meter/min. In any such third embodiment, either alone or in combination with any other embodiment or combination of embodiments listed herein, the furnish is a first furnish from a first source, and after passing through the mixing partition the first furnish is combined with a second furnish from a second source. In any such third embodiment, either alone or in combination with any other embodiment or combination of embodiments listed herein, the first source and the second source are pressurized sources. In any such third embodiment, either alone or in combination with any other embodiment or combination of embodiments listed herein, pressure is applied to the furnish by dispensing the furnish into the enclosed region. In any such third embodiment, either alone or in combination with any other embodiment or combination of embodiments listed herein, the source of furnish is a pressurized source. In any such third embodiment, either alone or in combination with any other embodiment or combination of embodiments listed herein, pressure is applied to the enclosed region by a source of hydraulic pressure. In any such third embodiment, either alone or in combination with any other embodiment or combination of embodiments listed herein, pressure is applied to the enclosed region by a compressed gas source. In any such third embodiment, either alone or in combination with any other embodiment or combination of embodiments listed herein, pressure is applied to the enclosed region by a pressure source not connected to the source of furnish. In any such third embodiment, either alone or in combination with any other embodiment or combination of embodiments listed herein, after the collecting the fiber and before drying of the wet layer, one or more additional materials are applied to the wet layer. In any such third embodiment, either alone or in combination with any other embodiment or combination of embodiments listed herein, the one or more additional materials comprise one or more resins, binders, fillers, particulates, flame retardants, chemically reactive compounds, coating materials, colorants, antioxidants, bactericidal compounds, fungicidal compounds, or a combination thereof. In any such third embodiment, either alone or in combination with any other embodiment or combination of embodiments listed herein, the additional materials are applied by spraying, dipping, curtain coating, die coating, roll coating, rotogravure coating, or plasma coating.

8. Fourth Embodiment

A fourth embodiment of the invention, either alone or in combination with any other embodiments or combination of embodiments listed in this section, contemplates an enclosed mixing partition assembly, the assembly comprising a mixing partition configured to provide a gradient in a nonwoven web; and an enclosure surrounding the mixing partition or a section thereof such that the mixing partition defines two or more openings, the enclosure adapted to provide an applied pressure therein, wherein the assembly further comprises at least one inlet for dispensing a fluid therein.

In any such fourth embodiment, either alone or in combination with any other embodiment or combination of embodiments listed herein, In any such fourth embodiment, either alone or in combination with any other embodiment or combination of embodiments listed herein, the pressure is applied to a fluid within the enclosure. In any such fourth embodiment, either alone or in combination with any other embodiment or combination of embodiments listed herein, the enclosure is a cuboid shape. In any such fourth embodiment, either alone or in combination with any other embodiment or combination of embodiments listed herein, the enclosure comprises a movable wall distal to the at least one inlet, wherein the movable wall is movable along a plane defined by the mixing partition. In any such fourth embodiment, either alone or in combination with any other embodiment or combination of embodiments listed herein, the assembly of claim 38 further comprising one or more sources of pressure attached to the enclosure and adapted to apply pressure within the enclosure. In any such fourth embodiment, either alone or in combination with any other embodiment or combination of embodiments listed herein, the source of pressure is compressed air or a hydraulic pump. In any such fourth embodiment, either alone or in combination with any other embodiment or combination of embodiments listed herein, the assembly further comprises one or more valves or pressure gauges attached thereto. In any such fourth embodiment, either alone or in combination with any other embodiment or combination of embodiments listed herein, the mixing partition further comprises one or more weirs extending into the enclosure and adapted to modify the flow of fluid near the one or more openings in the mixing partition. In any such fourth embodiment, either alone or in combination with any other embodiment or combination of embodiments listed herein, the assembly further comprises a flow distribution chamber. In any such fourth embodiment, either alone or in combination with any other embodiment or combination of embodiments listed herein, the two or more openings in the mixing partition are configured to provide a gradient through the thickness of a nonwoven web, such that the gradient is substantially uniform in the cross web direction. In any such fourth embodiment, either alone or in combination with any other embodiment or combination of embodiments listed herein, the two or more openings are rectangular slots extending across substantially the entirety of the width of the mixing partition, the width of the mixing partition corresponding to the cross web dimension of the web and the length of the slots. In any such fourth embodiment, either alone or in combination with any other embodiment or combination of embodiments listed herein, the width of the slots is about 0.05 cm to 25 cm. In any such fourth embodiment, either alone or in combination with any other embodiment or combination of embodiments listed herein, the distance between any two slots is about 2 cm to 100 cm.

The above specification, examples and data provide a complete description of the manufacture and use of the composition of the invention. Since many embodiments of the invention can be made without departing from the scope of the invention, the invention resides in the claims hereinafter appended.

We claim:

1. An apparatus for making a nonwoven web, the apparatus comprising:

a) one or more sources configured to dispense a first fluid flow stream and a second fluid flow stream, wherein at least the first fluid flow stream comprises a fiber;

b) a mixing partition downstream from the one or more sources, the mixing partition positioned between the first and second flow streams, the mixing partition defining two or more openings in the mixing partition that permit fluid communication between the two flow streams;

c) an enclosed region comprising an enclosure with at least one inlet for dispensing a fluid therein, wherein the enclosed region is situated downstream from the one or more sources, wherein the enclosed region surrounds at least a portion of the mixing partition, wherein the enclosed region is adapted to apply a pressure to the fluid and wherein the apparatus is configured so that the enclosed region is substantially filled with the fluid and no appreciable airspace is present in the enclosure during dispensing of the fluid through the openings; and d) a receiving region situated downstream from the one or more sources and designed to receive at least a combined flow stream and form a nonwoven web by collecting fiber from the combined flow stream, wherein openings of the mixing partition are above the receiving region.

2. The apparatus of claim 1 wherein the pressure is applied to urge the second flow stream through one or more openings in the mixing partition.

3. The apparatus of claim 1 wherein pressure is applied to the enclosed region by the second flow stream flowing into the enclosed region.

4. The apparatus of claim 3 wherein the second flow stream is dispensed under pressure.

5. The apparatus of claim 1 wherein pressure is applied to the enclosed region by a source of hydraulic pressure.

6. The apparatus of claim 1 wherein pressure is applied to the enclosed region by a source of pressure not connected to the one or more sources of first and second fluid flow streams.

7. The apparatus of claim 1 further comprising one or more valves appended to the enclosed region and adapted to release pressure in excess of a selected value, or release undispensed second flow stream from the enclosed region, or both.

8. The apparatus of claim 1 wherein at least a portion of the mixing partition, at least a portion of the enclosed region, or both are adapted to be removable from the apparatus.

9. The apparatus of claim 1 further comprising a flow distribution chamber located between the source of the second flow stream and the enclosed region, and in fluid communication with both the source and the enclosed region; wherein the flow distribution chamber is adapted to distribute the second flow stream evenly across the mixing partition in the cross-web direction.

10. The apparatus of claim 1 wherein the mixing partition is configured to provide a gradient in the nonwoven web.

11. An apparatus for making a nonwoven web, the apparatus comprising:

a) a first source configured to dispense a first fluid flow stream comprising a first fiber;

b) a second source configured to dispense a second fluid flow stream comprising a second fiber that is different from the first fiber;

c) a mixing partition downstream from the first and second sources, the mixing partition positioned between the first and second flow streams, the mixing partition defining two or more openings in the mixing partition that permit fluid communication between the first and second flow streams;

d) an enclosed region comprising an enclosure with at least one inlet for dispensing a fluid therein, wherein the enclosed region is situated downstream from the first and second sources, wherein the enclosed region surrounds at least a portion of the mixing partition, wherein the enclosed region adapted to apply a pressure to the fluid and wherein the apparatus is configured so that the enclosed region is substantially filled with the fluid and no appreciable airspace is present in the enclosure during dispensing of the fluid through the openings; and e) a receiving region situated downstream from the first and second sources and designed to receive at least a combined flow stream and form a nonwoven web by collecting the combined flow stream, wherein openings of the mixing partition are above the receiving region.

12. The apparatus of claim 11 wherein pressure is applied to the second flow stream to urge the second flow stream through one or more openings in the mixing partition.

13. The apparatus of claim 11 wherein pressure is applied to the enclosed region by the second flow stream flowing into the enclosed region.

14. The apparatus of claim 13 wherein the second flow stream is dispensed under pressure.

15. The apparatus of claim 11 wherein pressure is applied to the enclosed region by a source of hydraulic pressure.

16. The apparatus of claim 11 wherein pressure is applied to the enclosed region by a source of pressure not connected to the one or more sources of first and second fluid flow streams.

17. The apparatus of claim 11 further comprising one or more valves appended to the enclosed region and adapted to release pressure in excess of a selected value, or release undispensed second flow stream from the enclosed region, or both.

18. The apparatus of claim 11 wherein at least a portion of the mixing partition, at least a portion of the enclosed region, or both are adapted to be removable from the apparatus.

19. The apparatus of claim 11 further comprising a flow distribution chamber located between the source of the second flow stream and the enclosed region, and in fluid communication with both the source and the enclosed region; wherein the flow distribution chamber is adapted to distribute the second flow stream evenly across the mixing partition in the cross-web direction.

20. The apparatus of claim 11 wherein the mixing partition is configured to provide a gradient in the nonwoven web.

21. A method of making a nonwoven web, the method comprising:

a) providing a furnish from a source, the furnish comprising at least a first fiber, the step of providing the furnish from the source comprising providing a first fluid flow stream and a second fluid flow stream, wherein the first fluid flow stream comprises the first fiber;

b) dispensing the furnish across a mixing partition downstream from the source, the mixing partition defining two or more openings configured to allow passage of at least a portion of the furnish, the mixing partition further comprising an enclosed region comprising an enclosure with at least one inlet for dispensing a fluid into the enclosed region, the enclosed region surrounding at least a portion of the mixing partition and adapted to apply a pressure therein to the fluid, wherein the mixing partition is positioned between the first and second flow streams, the openings permitting fluid communication between the first and second flow streams, and wherein the enclosed region and source are configured so that the enclosed region is substantially filled with the fluid and no appreciable airspace is present in the enclosure during dispensing of the fluid through the openings;

c) applying a pressure within the enclosed region to the fluid;

d) collecting fiber from the furnish passing through the two or more openings on a receiving region situated downstream from the source to form a wet layer on the receiving region, the receiving region receiving a combined flow stream and forming the nonwoven web by collecting fiber from the combined flow stream, wherein openings of the mixing partition are above the receiving region; and e) drying the wet layer to form the nonwoven web.

22. The method of claim 21 wherein the pressure applied to the enclosed region urges the furnish through one or more of the openings in the mixing partition.

23. The method of claim 21 wherein the nonwoven web is formed at a line speed of about 10 meter/min to 2000 meter/min.

24. The method of claim 21 wherein the nonwoven web is formed at a line speed of about 100 meter/min to 1000 meter/min.

25. The method of claim 21 wherein the nonwoven web is formed at a line speed of about 500 meter/min to 2000 meter/min.

26. The method of claim 21 wherein the furnish is a first furnish from a first source, and after passing through the mixing partition the first furnish is combined with a second furnish from a second source.

27. The method of claim 26 wherein the first source and the second source are pressurized sources.

28. The method of claim 21 wherein pressure is applied to the furnish by dispensing the furnish into the enclosed region.

29. The method of claim 21 wherein the source of furnish is a pressurized source.

30. The method of claim 21 wherein pressure is applied to the enclosed region by a source of hydraulic pressure.

31. The method of claim 21 wherein pressure is applied to the enclosed region by a compressed gas source.

32. The method of claim 21 wherein pressure is applied to the enclosed region by a pressure source not connected to the source of furnish.

33. The method of claim 21 wherein after the collecting the fiber and before drying of the wet layer, one or more additional materials are applied to the wet layer.

34. The method of claim 33 wherein the one or more additional materials comprise one or more resins, binders, fillers, particulates, flame retardants, chemically reactive compounds, coating materials, colorants, antioxidants, bactericidal compounds, fungicidal compounds, or a combination thereof.

35. The method of claim 21 wherein the additional materials are applied by spraying, dipping, curtain coating, die coating, roll coating, rotogravure coating, or plasma coating.

36. An enclosed mixing partition assembly, the assembly comprising a) a mixing partition configured to provide a gradient in a nonwoven web; and b) an enclosure surrounding the mixing partition or a section thereof such that the mixing partition defines two or more openings, the enclosure adapted to provide an applied pressure therein, wherein the assembly comprises at least one inlet for dispensing a fluid therein and wherein the enclosure comprises a movable wall distal to the at least one inlet, wherein the movable wall is movable along a plane defined by the mixing partition.

37. The assembly of claim 36 wherein the pressure is applied to a fluid within the enclosure.

38. The assembly of claim 36 wherein the enclosure is a cuboid shape.

39. The assembly of claim 36 further comprising one or more sources of pressure attached to the enclosure and adapted to apply pressure within the enclosure.

40. The assembly of claim 39 wherein the source of pressure is compressed air or a hydraulic pump.

41. The assembly of claim 36 wherein the assembly further comprises one or more valves or pressure gauges attached thereto.

42. The assembly of claim 36 wherein the mixing partition further comprises one or more weirs extending into the enclosure and adapted to modify the flow of fluid near the one or more openings in the mixing partition.

43. The assembly of claim 36 further comprising a flow distribution chamber.

44. The assembly of claim 36 wherein the two or more openings in the mixing partition are configured to provide a gradient through the thickness of a nonwoven web, such that the gradient is substantially uniform in the cross web direction.

45. The assembly of claim 44 wherein the two or more openings are rectangular slots extending across substantially the entirety of the width of the mixing partition, the width of the mixing partition corresponding to the cross web dimension of the web and the length of the slots.

46. The assembly of claim 45 wherein the width of the slots is about 0.05 cm to 25 cm.

47. The assembly of claim 45 wherein the distance between any two slots is about 2 cm to 100 cm.

48. The apparatus of claim 1 wherein the enclosure comprises a movable wall distal to the at least one inlet, wherein the movable wall is movable along a plane defined by the mixing partition.

49. The apparatus of claim 11 wherein the enclosure comprises a movable wall distal to the at least one inlet, wherein the movable wall is movable along a plane defined by the mixing partition.

* * * * *